US009805893B2

(12) United States Patent
Shimoda

(10) Patent No.: US 9,805,893 B2
(45) Date of Patent: Oct. 31, 2017

(54) ELECTROMAGNETIC RELAY

(71) Applicant: OMRON Corporation, Kyoto-shi, Kyoto (JP)

(72) Inventor: Seiki Shimoda, Kumamoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/779,826

(22) PCT Filed: Jul. 31, 2013

(86) PCT No.: PCT/JP2013/070803
§ 371 (c)(1),
(2) Date: Sep. 24, 2015

(87) PCT Pub. No.: WO2014/174694
PCT Pub. Date: Oct. 30, 2014

(65) Prior Publication Data

US 2016/0086754 A1 Mar. 24, 2016

(30) Foreign Application Priority Data

Apr. 22, 2013 (JP) ..... 2013-089831

(51) Int. Cl.

| | |
|---|---|
| ***H01H 50/16*** | (2006.01) |
| ***H01H 50/36*** | (2006.01) |
| ***H01H 50/28*** | (2006.01) |
| ***H01H 50/64*** | (2006.01) |
| ***C23C 10/54*** | (2006.01) |
| ***C23C 10/56*** | (2006.01) |

(52) U.S. Cl.
CPC ..... *H01H 50/36* (2013.01); *C23C 10/54* (2013.01); *C23C 10/56* (2013.01); *H01H 50/16* (2013.01); *H01H 50/163* (2013.01); *H01H 50/28* (2013.01); *H01H 50/642* (2013.01); *H01H 2209/002* (2013.01)

(58) Field of Classification Search
None
See application file for complete search history.

(56) References Cited

U.S. PATENT DOCUMENTS

| | | | |
|---|---|---|---|
| 4,212,904 | A | 7/1980 | Dubinin et al. |
| 4,929,473 | A | 5/1990 | Marquez et al. |

(Continued)

FOREIGN PATENT DOCUMENTS

| | | | |
|---|---|---|---|
| CN | 101233248 | A | 7/2008 |
| GB | 905866 | A | 9/1962 |

(Continued)

OTHER PUBLICATIONS

International Search Report issued in PCT/JP2013/070803 mailed on Sep. 3, 2013 (2 pages).

(Continued)

*Primary Examiner* — Kevin Bernatz
(74) *Attorney, Agent, or Firm* — Osha Liang LLP

(57) ABSTRACT

An electromagnetic relay (100) has high wear resistance, high corrosion resistance, and good magnetic properties. The electromagnetic relay (100) includes a magnetic component including an alloy layer on its surface formed by diffusion-coating of at least one element selected from the group consisting of Cr, V, Ti, and Al. The alloy layer has a thickness of 5 to 60 μm, inclusive.

4 Claims, 30 Drawing Sheets

(56) References Cited

U.S. PATENT DOCUMENTS

| | | | | |
|---|---|---|---|---|
| 5,013,411 | A * | 5/1991 | Minowa | H01F 41/026 148/102 |
| 6,130,595 | A | 10/2000 | Niimi | |
| 6,635,361 | B1 * | 10/2003 | Sugihara | C21D 8/12 148/100 |
| 2002/0092586 | A1 * | 7/2002 | Weir | C23C 28/023 148/518 |
| 2006/0094551 | A1 | 5/2006 | Tohara | |
| 2007/0262668 | A1 * | 11/2007 | Brisson | F16C 32/0468 310/90.5 |
| 2008/0238591 | A1 * | 10/2008 | Takano | H01H 50/26 335/189 |
| 2008/0280716 | A1 | 11/2008 | Miyazawa | |
| 2012/0189868 | A1 * | 7/2012 | Borovik | C23C 16/20 428/615 |
| 2012/0313737 | A1 * | 12/2012 | Iwamoto | H01H 50/56 335/185 |

FOREIGN PATENT DOCUMENTS

| | | | |
|---|---|---|---|
| JP | H05-5173 | A | 1/1993 |
| JP | H06-196067 | A | 7/1994 |
| JP | H08-269640 | A | 10/1996 |
| JP | H10-92286 | A | 4/1998 |
| JP | H10-311381 | A | 11/1998 |
| JP | H11-339621 | A | 12/1999 |
| JP | 2003-027190 | A | 1/2003 |
| JP | 2006-132637 | A | 5/2006 |
| JP | 2007-181771 | A | 7/2007 |
| JP | 2007-327077 | A | 12/2007 |
| JP | 2008-144654 | A | 6/2008 |
| JP | 2008-281027 | A | 11/2008 |
| JP | 2012-153911 | A | 8/2012 |
| JP | 2014-214319 | A | 11/2014 |
| JP | 2014-216354 | A | 11/2014 |

OTHER PUBLICATIONS

Written Opinion of the International Searching Authority issued in PCT/JP2013/070803 mailed on Sep. 3, 2013 (3 pages).

Japanese Office Action in corresponding Application No. 2013-089831 mailed on May 7, 2015 (3 pages).

Japanese Office Action in corresponding Application No. 2013-089831 mailed on Aug. 20, 2013 (4 pages).

Japanese Office Action in corresponding Application No. 2013-089831 mailed on Dec. 10, 2013 (3 pages).

Japanese Office Action in corresponding Application No. 2013-089831 mailed on Mar. 25, 2014 (3 pages).

Japanese Office Action in corresponding Application No. 2013-089831 mailed on Mar. 10, 2015 (3 pages).

Extended European Search Report issued in corresponding European Application No. 13882726.6, mailed on Nov. 28, 2016 (8 pages).

Second Office Action issued in corresponding Chinese Application No. 201380075003.5, mailed on Mar. 2, 2017 (16 pages).

* cited by examiner

SPCC t1.2mm

Comparative Example 7

Comparative Example 8

Example 14

× 50

SPCC t1.2mm Comparative Example 7

SPCC t1.2mm Comparative Example 8

SPCC t1.2mm Comparative Example 14

SPCC t1.6mm

Comparative Example 9

Comparative Example 10

Example 15

×50

SPCC t1.6mm Comparative Example 9

SPCC t1.6mm Comparative Example 10

SPCC t1.6mm Example 15

Comparative Example 11

Example 16

Example 17

Example 18

Example 19

| Comparative Example 12 (Ni-plated product) | Example 20 (Chromizing) |
| --- | --- |
| Fig. 29A<br>Iron piece<br> 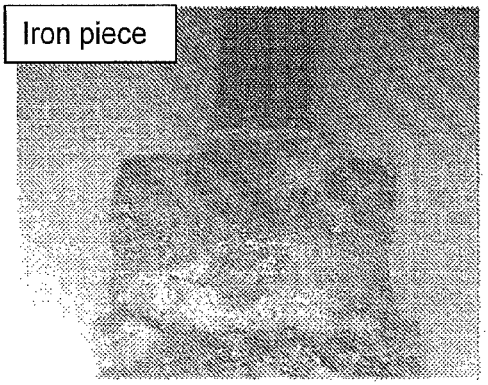 | Fig. 29C<br>Iron piece<br> 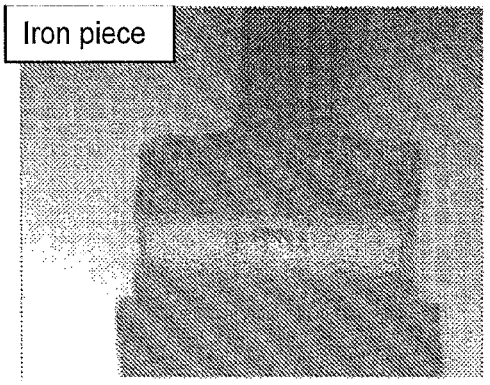 |
| Fig. 29B<br>Yoke<br> 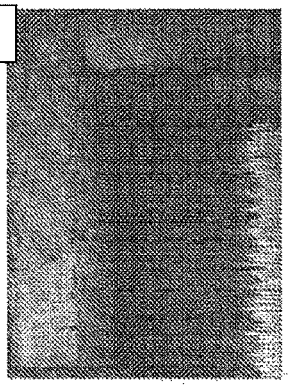 | Fig. 29D<br>Yoke<br> 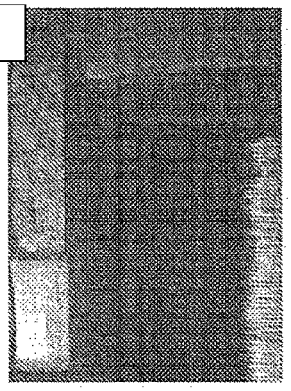 |

ELECTROMAGNETIC RELAY

FIELD

The present invention relates to an electromagnetic relay including magnetic components with improved wear resistance, corrosion resistance, and magnetic properties.

BACKGROUND

Magnetic components used in electronic devices such as electromagnetic relays (also referred to as relays) are plated with nickel to provide corrosion resistance. FIG. 30 is a perspective view of a relay 200 known in the art. The relay 200 includes a yoke 201, an iron piece 202, and an iron core 203, which are magnetic components plated with nickel. Nickel (Ni) plating covers the surfaces of the components. The Ni plating layers need to be thicker to improve corrosion resistance. However, thicker Ni plating layers can affect mating of the components.

Thin Ni plating layers can also cause problems. When, for example, an electric contact in a sealed relay is open and closed under high voltage and high current, it generates arc heat, which then produces nitric acid. Such nitric acid can corrode the plating, and can form patina on the surface of the magnetic component. As this reaction proceeds, the relay can malfunction.

Further, a relay including a sliding part (hinge) can have its operating characteristics varying greatly when the hinge part is mechanically worn by sliding. To overcome this, a lubricating oil is applied to the hinge part during assembly of the relay. However, no lubricating oil is added again to the hinge part during the service life of the relay. The hinge part can thus wear with time.

In response to such difficulties associated with the thickness of Ni plating and its corrosion resistance, techniques using chrome have been developed. Patent Literature 1 describes a soft magnetic stainless steel containing chrome used for an iron core of a relay. Patent Literature 2 describes an electromagnetic material containing chrome used for a relay. The stainless steel described in Patent Literature 1 and the electromagnetic material described in Patent Literature 2 contain chrome, and eliminate difficulties associated with the thickness.

Techniques using chrome have also been developed to achieve wear resistance. Patent Literatures 3 to 5 describe chromized chains and chromized pins for chains. The techniques described in Patent Literatures 3 to 5 use diffusion-coating of chrome on the surface of a chain or a chain pin to improve wear resistance. The chromizing allows chrome to diffuse and penetrate into the base material, and thus prevents the thickness from increasing.

Patent Literature 6 describes a method of chromizing. With the technique described in Patent Literature 6, a mixture of chrome metal powder and at least one metal powder of an element selected from the group consisting of Zn, W, Ti, and Mo is used to form a chrome diffusion layer. The technique described in Patent Literature 6 can form a very thick chrome diffusion layer, thus providing improved corrosion resistance.

CITATION LIST

Patent Literature

Patent Literature 1: Japanese Unexamined Patent Application Publication No. 8-269640 (published on Oct. 15, 1996)

Patent Literature 2: Japanese Unexamined Patent Application Publication No. 2003-27190 (published on Jan. 29, 2003)

Patent Literature 3: Japanese Unexamined Patent Application Publication No. 10-311381 (published on Nov. 24, 1998)

Patent Literature 4: Japanese Unexamined Patent Application Publication No. 2006-132637 (published on May 25, 2006)

Patent Literature 5: Japanese Unexamined Patent Application Publication No. 2008-281027 (published on Nov. 20, 2008)

Patent Literature 6: Japanese Unexamined Patent Application Publication No. 5-5173 (published on Jan. 14, 1993)

SUMMARY

Technical Problem

However, the techniques known in the art cannot provide an electromagnetic relay having high wear resistance, high corrosion resistance, and good magnetic properties.

For example, the techniques described in Patent Literatures 1 and 2 use an alloy containing chrome. With the alloy containing chrome uniformly, the base material has an insufficiently grown metallic structure. Thus, the relay component formed from the alloy described in Patent Literatures 1 and 2 has insufficient magnetic properties, and thus cannot serve intended use.

Also, the chains and the chain pins described in Patent Literatures 3 to 5 are formed from a material containing more carbon to increase hardness. In this case, the metallic structure is grown insufficiently, and cannot provide the material with sufficient magnetic properties.

The technique described in Patent Literature 6 forms a very thick chrome diffusion layer, and thus increases magnetic resistance. The technique described in Patent Literature 6 cannot be used for magnetic components.

In response to the above issue, the present invention is directed to an electromagnetic relay having high wear resistance, high corrosion resistance, and good magnetic properties.

Solution to Problem

An electromagnetic relay according to embodiments of the invention includes an electromagnetic device and a contact. The electromagnetic device includes a magnetic component and a coil. The magnetic component includes an iron component prepared by processing an iron material. The contact is open and closed in cooperation with magnetization and demagnetization of the electromagnetic device. The iron component includes an alloy layer on a surface thereof, and the alloy layer is formed by diffusion-coating of at least one element selected from the group consisting of Cr, V, Ti, Al, and Si. The alloy layer has a thickness in a range of 5 to 60 μm inclusive.

Advantageous Effects

The electromagnetic relay in one or more embodiments of the invention includes a magnetic device and a contact. The magnetic device includes a magnetic component and a coil. The magnetic component includes an iron component prepared by processing an iron material. The contact is open and closed in cooperation with magnetization and demagnetization of the electromagnetic device. The iron component includes an alloy layer on a surface thereof, and the alloy layer is formed by diffusion-coating of at least one element selected from the group consisting of Cr, V, Ti, Al, and Si. The alloy layer has a thickness in a range of 5 to 60 μm inclusive.

This provides an electromagnetic relay having high wear resistance, high corrosion resistance, and good magnetic properties.

BRIEF DESCRIPTION OF THE DRAWINGS

FIGS. 29A to 29D are diagrams showing the test results of example 20 of the present invention and comparative example 12.

DETAILED DESCRIPTION

Figure 1:
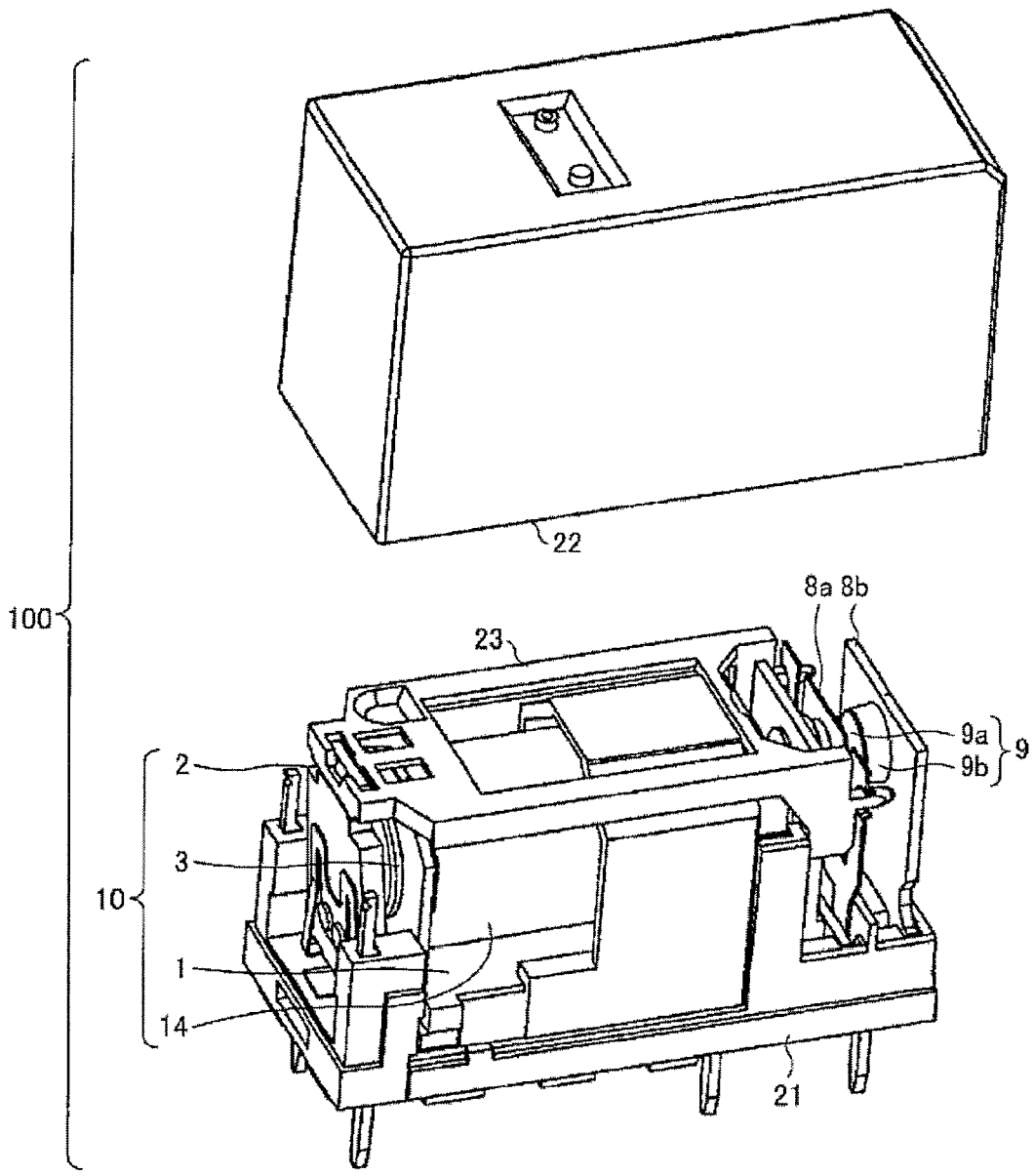
FIG. 1 is an exploded perspective view of an electromagnetic relay according to one embodiment of the present invention.

Although embodiments of the present invention will be described in detail, the invention is not limited to these embodiments. For convenience of explanation, the components with the same functions are given the same reference numerals and are not described. In the figures, x-axis, y-axis, and z-axis define the directions in a three-dimensional space.

Electromagnetic Relay

FIG. 1 is an exploded perspective view of an electromagnetic relay 100 according to one embodiment of the present invention. The electromagnetic relay 100 according to the embodiment includes an electromagnetic device 10 and a contact 9. The electromagnetic device 10 includes a magnetic component and a coil 14. The contact 9 is open and closed in cooperation with magnetization and demagnetization of the electromagnetic device 10. The electromagnetic relay 100 may include a base 21 and a case 22. The electromagnetic device 10 and the contact 9 may be arranged on the base 21. The case 22 may be engaged with the outer edge of the base 21 and accommodate the components arranged on the base 21.

Figure 2:
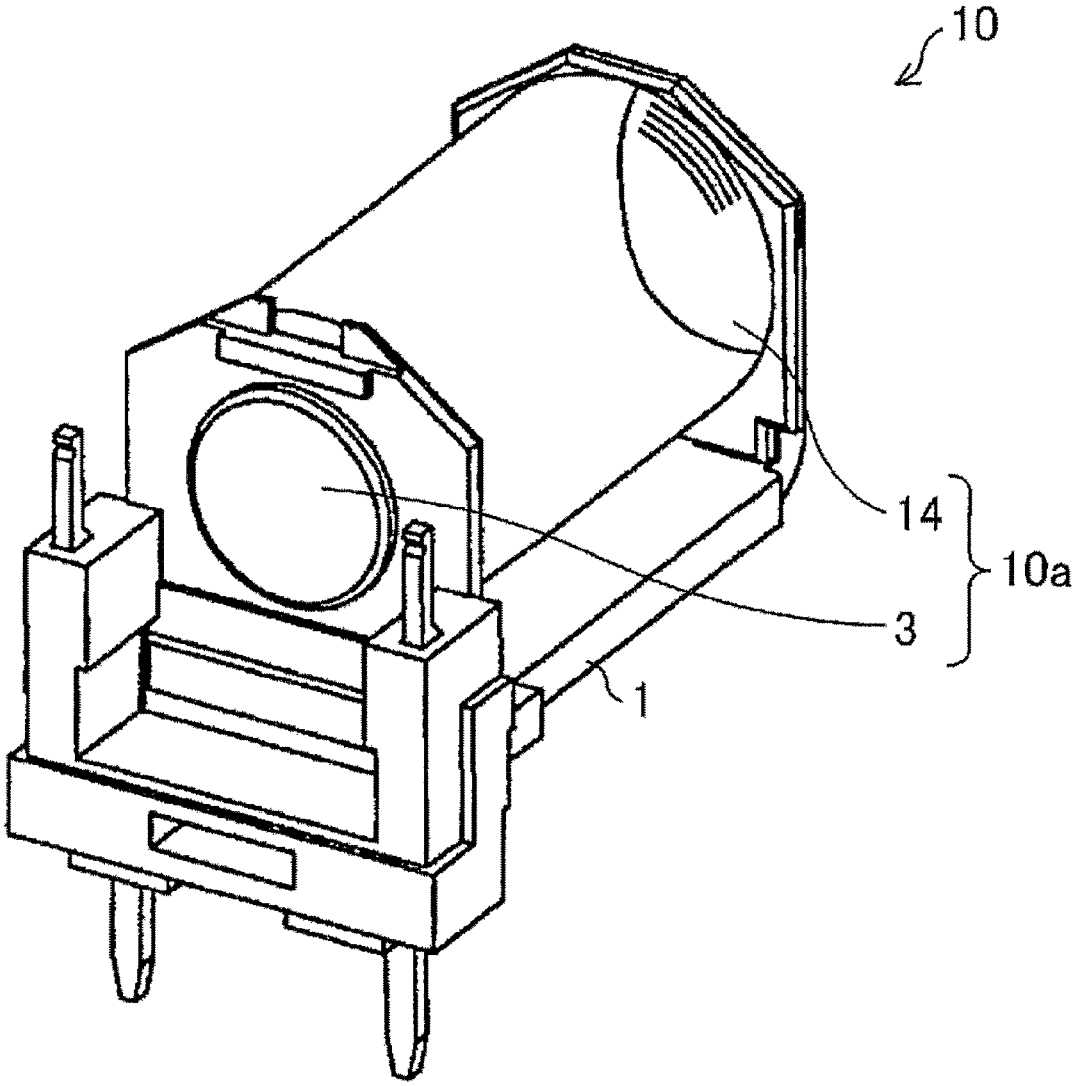
FIG. 2 is a perspective view of an electromagnetic device included in the electromagnetic relay according to the embodiment.

FIG. 2 is a perspective view of the electromagnetic device 10. The electromagnetic device 10 includes, for example, a yoke 1, an iron piece 2, and an iron core 3. The iron piece 2 is not shown in FIG. 2. At least one of the yoke 1, the iron piece 2, and the iron core 3 in the electromagnetic device 10 functions as a magnetic component according to the present embodiment. The yoke 1, the iron piece 2, and the iron core 3 may all be magnetic components according to the present embodiment. The coil 14 is wound around the iron core 3.

The iron core 3 and the coil 14 herein may be together referred to as an electromagnetic part 10*a*.

Figure 3:
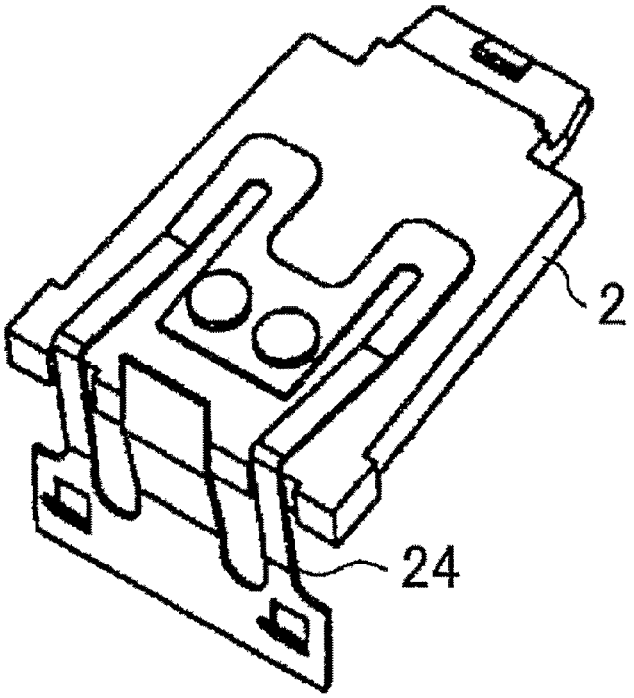
FIG. 3 is a perspective view of an iron piece included in the electromagnetic relay according to the embodiment.

FIG. 3 is a perspective view of the iron piece 2. The iron piece 2 may include a hinge spring 24. The iron piece 2 may be joined to the base 21 with the hinge spring 24.

Although the contact 9 may have any structure, the contact 9 may include a movable contact 9*a* included in a movable contact piece 8*a* and a fixed contact 9*b* included in a fixed contact piece 8*b* as shown in FIG. 1. The movable contact piece 8*a* and the fixed contact piece 8*b* are joined to the base 21. The movable contact piece 8*a* is connected to the iron piece 2 with, for example, an intermediate member (card 23). When a voltage is applied to the coil 14, the electromagnetic part 10*a* is magnetized, and the iron piece 2 is attracted to the iron core 3. The iron piece 2, which is pressed by the hinge spring 24, separates from the iron core 3 as the electromagnetic part 10*a* is demagnetized. The card 23 moves in cooperation with this movement of the iron piece 2 as the electromagnetic part 10*a* is magnetized or demagnetized. In cooperation with the movement of the card 23, the contact 9 is open and closed.

The electromagnetic relay according to the embodiment may be, for example, a sealed relay or a hinged relay.

The magnetism or the magnetic properties herein refers to the property of having attraction force and coercive force, which will be described later. The good magnetism or magnetic properties refers to the property of having attraction force and coercive force at least equivalent to or exceeding the attraction force and the coercive force of a Ni-plated magnetic component known in the art.

A magnetic component plated with Ni known in the art herein may be simply referred to as a Ni-plated product or a conventional product.

Magnetic Component

The magnetic component includes an iron component prepared by processing an iron material. The iron component includes an alloy layer on its surface formed by diffusion-coating of at least one element selected from the group consisting of Cr, V, Ti, Al, and Si. The alloy layer has a thickness in a range of 5 to 60 μm, inclusive.

Figure 4A:
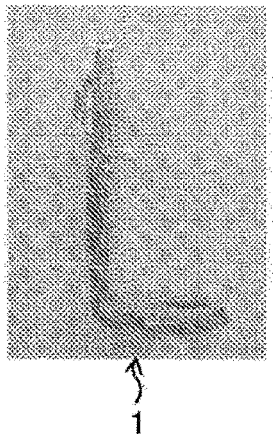
FIGS. 4A to 4C are diagrams showing the appearance of magnetic components included in the electromagnetic relay according to the embodiment.
Figure 4B:
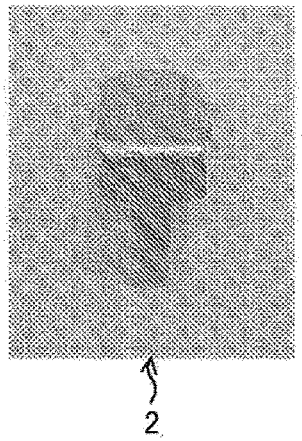
Figure 4C:
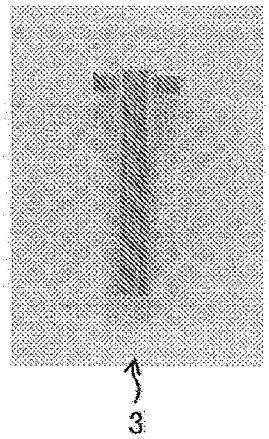
Figure 5:
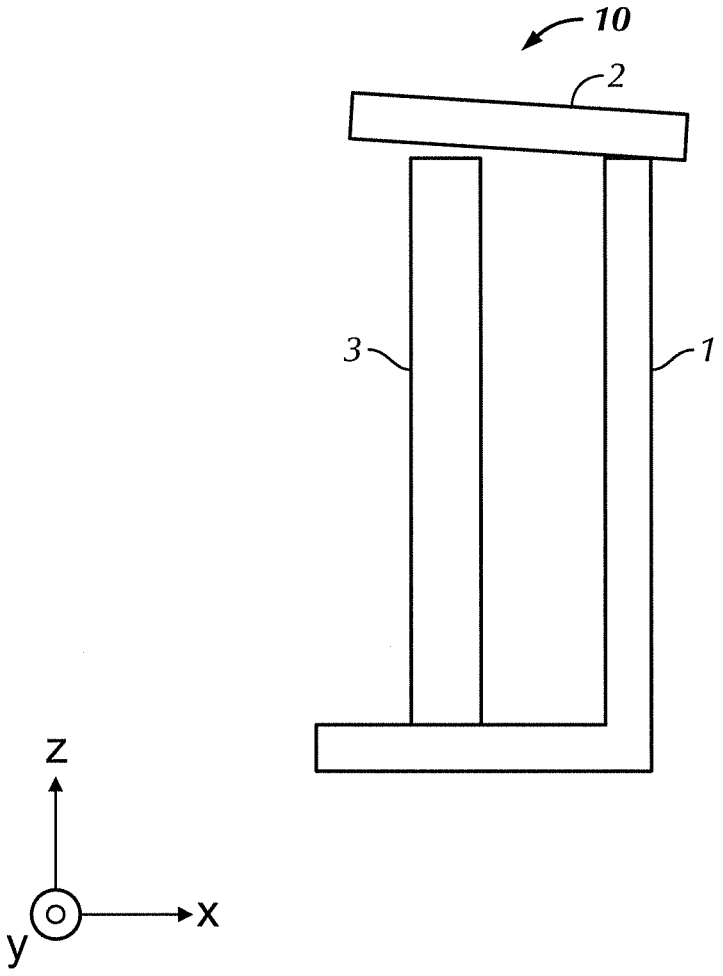
FIG. 5 is a cross-sectional view of the electromagnetic device included in the electromagnetic relay according to the embodiment.

The magnetic component may be the yoke 1 (FIG. 4A), the iron piece 2 (FIG. 4B), and/or the iron core 3 (FIG. 4C). The magnetic component may be an iron component with an alloy layer (described later), or may be an iron component combined with other components. FIG. 5 is a cross-sectional view of the electromagnetic device 10 showing the positional relationship between the yoke 1, the iron piece 2, and the iron core 3.

Iron Component

The magnetic component includes an iron component prepared by processing an iron material. The iron material herein refers to any typical iron alloy mainly composed of iron. The iron material may be, for example, pure iron or steel. The steel may be, for example, a cold-rolled steel plate, a hot-rolled steel plate, or an electromagnetic steel plate. The iron material may contain silicon, and may be, for example, a silicon steel plate. The iron material may be in any form, such as a band or a bar.

The iron component herein refers to a component with an intended shape formed from an iron material. The iron material may be processed into the iron component with any method, such as press work. The shape and the size of the iron component are determined depending on its application.

In some embodiments, the iron material has a carbon content in a range of 0 to 0.15 wt % inclusive, or in a range of 0 to 0.05 wt % inclusive. In some other embodiments, the carbon content is not less than 0 wt % and less than 0.01 wt %. The iron material containing less carbon can be processed into an iron component having a sufficiently grown metallic structure in a magnetic component. This enables the magnetic component to have good magnetic properties.

The iron component may have a ferritic grain size of not more than 1 defined by JIS G0551 (2005). The ferritic grain size of not more than 1 herein refers to, for example, the grain size of 1, 0, −1, −2, or less. This iron component contains large crystal grains and a sufficiently grown metallic structure, and thus provides a magnetic component having good magnetic properties. The grain size of the iron component herein refers to the grain size in an area of the iron component inward from the alloy layer as viewed from the surface of the iron component.

The surface of the iron component herein refers to at least one of all the surfaces of the iron component unless otherwise specified. All the surfaces of the iron component may be coated with an alloy layer. Although a part of each surface of the iron component coated with the alloy layer may be diffusion-coated with the at least one element, the largest possible part or the entire surface may be diffusion-coated with the element. This allows the iron component to have all the surfaces with high wear resistance and corrosion resistance, and allows the magnetic component to have good magnetic properties.

The area inward from the alloy layer or in a layer lower than the alloy layer as viewed from the surface of the iron component herein refers to an area that is not diffusion-coated with the at least one element selected from the group consisting of Cr, V, Ti, Al, and Si. When, for example, all the surfaces of the iron component are coated with an alloy layer, an area inward from the alloy layer or in a layer lower than the alloy layer as viewed from the surface of the iron component is an area surrounded by the alloy layer.

Alloy Layer

In the electromagnetic relay according to embodiments of the present invention, the iron component includes an alloy layer on its surface formed by diffusion-coating of at least one element selected from the group consisting of Cr, V, Ti, Al, and Si. The alloy layer has a thickness in a range of 5 to 60 μm, inclusive.

This structure allows the iron component, which is prepared by processing an iron material, to have sufficiently' high hardness. The resultant magnetic component thus has high wear resistance. This provides an electromagnetic relay that has less wear against mechanical sliding and has a long service life.

When, for example, an electric contact of a sealed relay is open and closed under high voltage and high current, it generates arc heat, which then produces nitric acid. Such nitric acid can corrode the Ni plating of the magnetic component known in the art to form patina on the surface of the magnetic component. However, the above magnetic component includes the alloy layer, and thus reduces such patina. The magnetic component can thus have high corrosion resistance. This provides an electromagnetic relay having high corrosion resistance.

The alloy layer herein refers to a layer of at least one element selected from the group consisting of Cr, V, Ti, Al, and Si formed by diffusing-coating, or the element diffusing and penetrating from the surface into the iron component. The alloy layer may contain a compound of the element and carbon or other elements contained in the iron material.

Unlike Ni plating, the alloy layer formed by diffusion-coating does not greatly increase the thickness of the component. The alloy layer does not affect mating between components.

Although the alloy layer may be as thick as possible to increase wear resistance and corrosion resistance, a thicker alloy layer formed from Cr, V, Ti, Al, and Si, which are non-magnetic materials, will increase magnetic resistance and is unsuited for a magnetic component. A thicker alloy layer will also prevent growth of its internal metallic structure.

The magnetic component includes the alloy layer having a thickness of not less than 5 μm, and thus has high wear resistance and high corrosion resistance. The alloy layer has a thickness of not more than 60 μm, and thus prevents the magnetic resistance from increasing. The alloy layer with a thickness of not more than 60 μm does not prevent growth of its internal metallic structure. This allows the iron component to have a sufficiently grown metallic structure. The resultant magnetic component having good magnetic properties can be used as, for example, an electromagnet in an electromagnetic relay having good magnetic properties. The above structure provides an electromagnetic relay having high wear resistance and high corrosion resistance as well as good magnetic properties.

In some embodiments, the alloy layer has a thickness in a range of 5 to 35 μm, inclusive. The alloy layer with this thickness is less likely to affect the growth of the metallic structure. This provides a magnetic component having high wear resistance and high corrosion resistance, as well as good magnetic properties.

The thickness of the alloy layer can be measured at a cross-section resulting from perpendicularly cutting any surface of the iron component on which the alloy layer is formed. For a rectangular-parallelepiped iron component, the thickness of its alloy layer may be measured on a rectangular cross-section resulting from perpendicularly cutting any surface of the component on which the alloy layer is formed. For a spherical iron component, the thickness of its alloy layer may be measured on a circular cross-section resulting from perpendicularly cutting any surface of the component through the center of the sphere.

The alloy layer may be formed by diffusion-coating of at least one element selected from the group consisting of Cr, V, Ti, Al, and Si, or of two or more of these elements. The alloy layer may contain two or more of the elements at any ratio.

The maximum total content of Cr, V, Ti, Al, and/or Si in the alloy layer may be in a range of 20 to 65 wt % inclusive in some embodiments, or in a range of 20 to 60 wt % inclusive in some other embodiments. This total content of elements is large enough to provide the alloy layer with wear resistance and corrosion resistance, and is less likely to affect the magnetic properties. This provides a magnetic component having high wear resistance and high corrosion resistance, as well as better magnetic properties.

The maximum total content of the above elements can be calculated through element concentration analysis with, for example, an electron probe micro analyzer (EPMA). The maximum total content of the elements refers to the largest one of the values indicating the total content measured at a plurality of positions in the alloy layer using, for example, an EPMA. When, for example, the content of Cr in the alloy layer measured at a distance of 5 μm from the surface of the iron component is 50 wt % and the Cr content measured at a distance of 10 μm from the surface is 10 wt %, the maximum Cr content is 50 wt %.

When the alloy layer contains two or more of the above elements, the maximum total content of the elements is in a range of 20 to 65 wt % inclusive in some embodiments, and is in a range of 20 to 60 wt % inclusive in some other embodiments. For an alloy layer containing diffusion-coated Cr and V, for example, the maximum total content of Cr and V may fall within the above ranges.

Method for Manufacturing Magnetic Component

The magnetic component includes an iron component prepared by processing an iron material. A method for manufacturing the magnetic component includes alloy layer formation, in which an alloy layer is formed by diffusion-coating the iron component with at least one element selected from the group consisting of Cr, V, Ti, Al, and Si. The diffusion-coating of the elements is performed with a treatment time of 5 to 15 hours inclusive at a treatment temperature of 750 to 950° C. inclusive.

The surface of the iron component, which is formed by processing an iron material, is coated with the alloy layer by diffusion-coating of at least one element selected from the group consisting of Cr, V, Ti, Al, and Si. The resultant magnetic component can have sufficiently high hardness. This provides a magnetic component having high wear resistance.

The alloy layer is formed on the surface of the iron component, and allows the magnetic component to have high corrosion resistance against nitric acid or other compounds.

The diffusion-coating process is performed with a predetermined treatment time at a predetermined temperature to control the thickness of the alloy layer as well as to allow the metallic structure to grow. This prevents the alloy layer from increasing the magnetic resistance, and allows the magnetic component to have good magnetic properties.

The above structure allows the magnetic component to have high wear resistance and high corrosion resistance, as well as good magnetic properties. A method for manufacturing a magnetic component included in an electromagnetic relay according to embodiments of the present invention will now be described in detail. The processes associated with the iron component and the alloy layer described above will not be described in detail.

Diffusion-Coating of Elements on Iron Component

The method for manufacturing the magnetic component includes diffusing-coating of at least one element selected from the group consisting of Cr, V, Ti, Al, and Si on the iron component. The diffusion-coating of the element on the iron component forms an alloy layer on the surface of the iron component.

The at least one element selected from the group consisting of Cr, V, Ti, Al, and Si may be in powder form. The powder may be of one element selected from the group consisting of Cr, V, Ti, Al, and Si, or may be of two or more of these elements. The powder may contain two or more of the elements at any ratio that provides high wear resistance and high corrosion resistance and good magnetic properties. The powder may be solely of at least one element selected from the group consisting of Cr, V, Ti, Al, and Si, or may be of a compound or an alloy containing the at least one element. The alloy containing the at least one element may be, for example, an alloy of the at least one element with iron.

The powder containing the at least one element selected from the group consisting of Cr, V, Ti, Al, and Si may be provided as a penetrant further containing other materials. The penetrant may be, for example, a mixture of the powder containing the at least one element, alumina powder, and ammonium chloride powder at any ratio. This penetrant increases the efficiency of the diffusion-coating process.

Alloy Layer Formation

The alloy layer formation process will now be described in detail.

Figure 6:
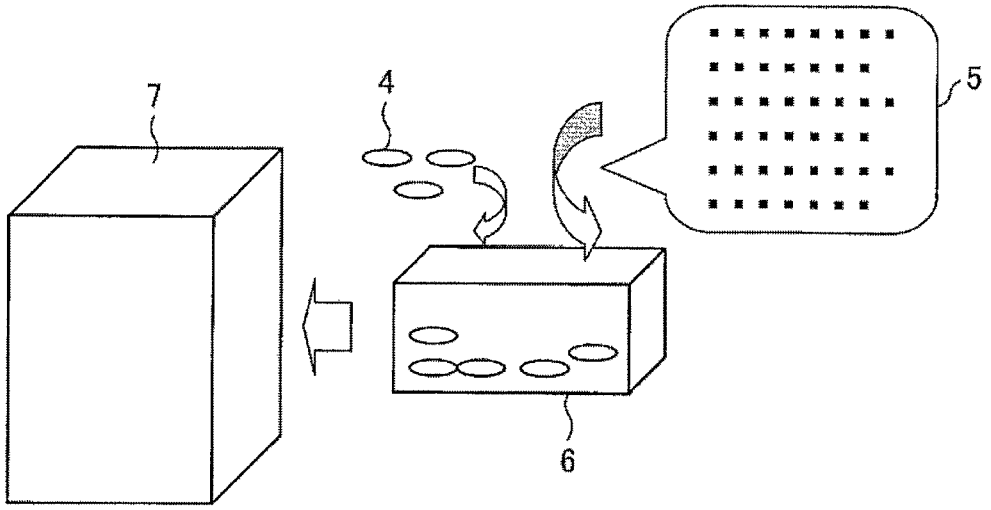
FIG. 6 is a schematic view illustrating a method for manufacturing a magnetic component included in the electromagnetic relay according to the embodiment.

FIG. 6 is a schematic view illustrating a method for manufacturing the magnetic component. First, iron components 4, which are prepared by processing an iron material, are placed into a box 6. The iron components 4 in the box may be arranged without contacting with each other. This allows an alloy layer formed on each iron component 4 to have substantially uniform thickness across the entire surface of each component, and eliminates thickness variations across different positions of the component, which can occur to a Ni-plated component.

Subsequently, powder 5 containing at least one element selected from the group consisting of Cr, V, Ti, Al, and Si is fed into the box 6. The iron components 4 are completely buried in the powder 5.

The box 6 is then placed inside a furnace 7, and undergoes the treatment time and the treatment temperature (described below), with which the powder 5 can diffuse and penetrate into each iron component 4. The treatment time and the treatment temperature in combination allow diffusion-coating of at least one element selected from the group consisting of Cr, V, Ti, Al, and Si onto each iron component to form an alloy layer on each iron component, and further allow the metallic structure of each iron component to grow. The process for diffusion-coating of at least one element selected from the group consisting of Cr, V, Ti, Al, and Si on an iron component herein may simply be referred to as the diffusion-coating process. The diffusion-coating of Cr in particular herein refers to chromizing.

After the diffusion-coating process, the box 6 is removed from the furnace 7, and the iron components 4 are removed from the box 6. The iron components 4 are cleaned and dried as appropriate.

Treatment Time and Treatment Temperature

In the diffusion-coating process described above, the treatment time is in a range of 5 to 15 hours inclusive in some embodiments, and is in a range of 8 to 10 hours inclusive in some other embodiments. The treatment temperature is in a range of 750 to 950° C. inclusive in some embodiments, is in a range of 750 to 900° C. inclusive in some other embodiments, is in a range of 750 to 900° C. inclusive in still other embodiments, and is in a range of 750 to 850° C. inclusive in still other embodiments.

The diffusion-coating process performed for at least 5 hours at 750° C. or higher temperatures will form an alloy layer that is thick enough to provide wear resistance and corrosion resistance, and allow the metallic structure to grow sufficiently. The diffusion-coating process performed for not more than 15 hours at 950° C. or lower temperatures can control the thickness of the alloy layer to a thickness that does not increase the magnetic resistance and does not prevent growth of the metallic structure.

The thickness of the alloy layer that provides wear resistance and corrosion resistance, and does not increase the magnetic resistance and does not prevent growth of the metallic structure is, for example, in a range of 5 to 60 μm inclusive, and is in a range of 5 to 35 μm inclusive in some other embodiments.

The diffusion-coating process performed with the treatment time and the treatment temperature described above allows the crystal grains in the iron component to grow to the ferritic grain size of not more than 1 defined by JIS G0551 (2005). The resultant iron component has a sufficiently grown metallic structure. This provides a magnetic component having good magnetic properties.

Comparison with Ni-Plated Product Manufacturing Method

Figures 7A, 7B:
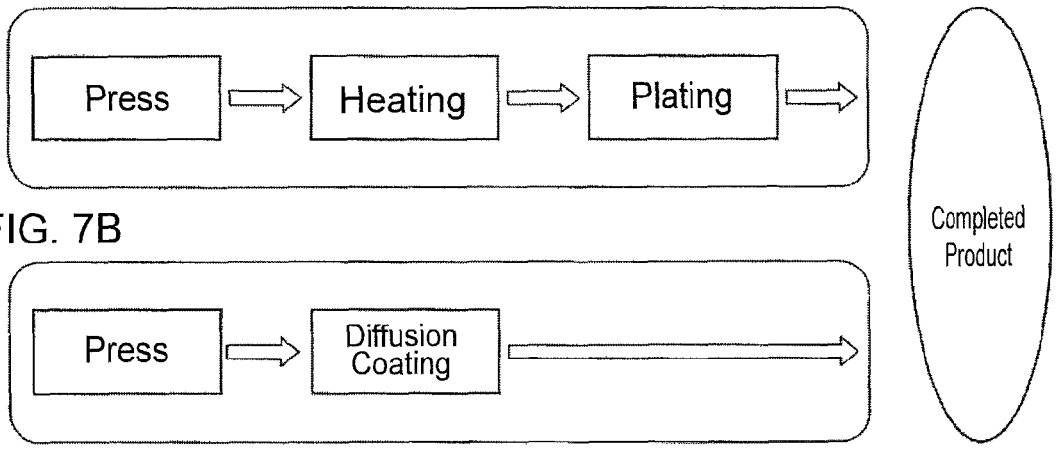
FIGS. 7A and 7B are schematic views comparing a method for manufacturing a magnetic component known in the art and a method for manufacturing a magnetic component included in the electromagnetic relay according to embodiments of the present invention.

The manufacturing method described above simplifies the processes for manufacturing the magnetic component, and thus reduces the cost for manufacturing the magnetic component. FIGS. 7A and 7B are schematic views comparing a method for manufacturing a Ni-plated product known in the art (FIG. 7A) and the method for manufacturing the magnetic component included in the electromagnetic relay according to embodiments of the present invention (FIG. 7B).

The method for manufacturing a Ni-plated product known in the art includes a first process of pressing an iron material, which is mainly an iron plate, into a predetermined shape, and includes a second process of heating the workpiece at 800 to 900° C. for 15 to 30 minutes in a non-oxidizing or reductive environment to provide intended magnetic properties. To increase the size of the metal grains to improve the magnetic properties, the workpiece may be heated for a longer period of time. However, the heat treatment is typically performed for the shortest time of about 15 minutes for the cost effectiveness. The method further includes a third process of plating the workpiece with nickel to increase the corrosion resistance of the component. These three processes have different purposes and are performed with different methods. These are necessary manufacturing processes for magnetic component, and none of them can be omitted.

In contrast, the manufacturing method for the magnetic component included in the electromagnetic relay according to embodiments of the present invention includes the diffusion-coating process involving heating, which grows the metallic structure and forms the alloy layer at the same time. This method thus includes two processes, namely, press and diffusion-coating. This method provides the magnetic component with intended magnetic properties, and wear resistance and corrosion resistance higher than those of a Ni-plated product known in the art, and further simplifies the manufacturing processes.

For the Ni-plating process involving electroplating, components are not plated one by one. To minimize the cost, a predetermined number of components are placed in a cage and are plated together while the cage is being rotated. With this method, the components can deform easily due to the weight of each component or due to their movements during the rotation. This can produce defective components. Further, although the entire surface of each component is plated, the components rub each other on their surfaces as the plating proceeds. This easily causes variations in the plating thickness across the components depending on the shape of the components, and further easily causes variations in the plating thickness across different positions of each component. To provide corrosion resistance across the entire surface of a component, the average plating thickness across the entire component is inevitably thicker than necessary. Further, although this method allows mass plating of components at a time, the resultant plating thickness is relatively small, and can also vary. The plating process is thus usually performed twice to obtain the average thickness of about 5 to 10 μm. This method thus actually involves four processes from processing the material to completing the product.

In contrast, the method for manufacturing the magnetic component included in the electromagnetic relay according to embodiments of the present invention eliminates the process of rotating the components in the cage, which is performed with the Ni plating method, and thus eliminates deformation of the components. Further, the diffusion-coating process forms the alloy layer with substantially uniform thickness across the entire surface of each component, and thus causes less dimensional variations across the individual components. This method thus does not affect mating between components, and eliminates defects in the assembly caused by variations in the plating thickness, which can occur to Ni-plated products known in the art.

The present invention is not limited to the embodiments described above, and may be changed variously within the scope designated by the appended claims. The technical methods described in the embodiments in combination as appropriate also fall within the technical scope of the present invention.

The embodiments of the present invention may be modified in the following forms.

In response to the above issue, an electromagnetic relay according to embodiments of the present invention includes an electromagnetic device and a contact. The electromagnetic device includes a magnetic component and a coil. The magnetic component includes an iron component prepared by processing an iron material. The contact is open and closed in cooperation with magnetization and demagnetization of the electromagnetic device. The iron component includes an alloy layer on a surface thereof formed by diffusion-coating of at least one element selected from the group consisting of Cr, V, Ti, Al, and Si. The alloy layer has a thickness in a range of 5 to 60 μm, inclusive.

The iron component prepared by processing an iron material includes an alloy layer on its surface. The alloy layer is formed by diffusion-coating of at least one element selected from the group consisting of Cr, V, Ti, Al, Si. This structure allows the magnetic component to have sufficiently high hardness, and thus have high wear resistance. This provides an electromagnetic relay having less wear against mechanical sliding and having a long service life.

The iron component includes the alloy layer. The resultant magnetic component thus has high corrosion resistance against nitric acid or other compounds. This enables the electromagnetic relay to have high corrosion resistance against nitric acid, which can occur inside the electromagnetic relay due to arc heat generated when the contact is open and closed.

The alloy layer has a thickness of 5 to 60 μm, inclusive. The alloy layer with this thickness does not prevent growth of the metallic structure of the iron material in a layer lower than the alloy layer as viewed from the surface of the iron component. This allows the iron component to have a sufficiently grown metallic structure, and allows the magnetic component to have good magnetic properties, although the alloy layer is formed by non-magnetic elements such as Cr, V, Ti, Al, and Si. This provides an electromagnetic relay having good magnetic properties including the magnetic component as an electromagnet.

The alloy layer formed by diffusion-coating does not greatly increase the thickness of the component. The alloy layer does not affect mating between components.

The above structure provides an electromagnetic relay having high wear resistance and high corrosion resistance, as well as good magnetic properties.

A method for manufacturing a magnetic component included in the electromagnetic relay according to embodiments of the present invention includes forming an alloy layer and growing a metallic structure in a single process. This method simplifies the manufacturing processes, and thus reduces the cost for manufacturing the magnetic component.

In the electromagnetic relay according to embodiments of the present invention, the alloy layer has a total of a maximum content of the at least one element selected from the group consisting of Cr, V, Ti, Al, and Si in a range of 20 to 65 wt %, inclusive.

The total content of the at least one element in the alloy layer is large enough to provide wear resistance and corrosion resistance, and is less likely to affect the growth of the metallic structure. This structure thus allows the electromagnetic relay to have high wear resistance and high corrosion resistance, as well as good magnetic properties.

The maximum content of the at least one element refers to the largest one of the values indicating the total content of the at least one element measured at a plurality of positions in the alloy layer.

In the electromagnetic relay according to embodiments of the present invention, the alloy layer may be formed by diffusion-coating of the at least one element selected from the group consisting of Cr, V, Ti, Al, and Si on the iron component with a treatment time in a range of 5 to 15 hours inclusive at a treatment temperature in a range of 750 to 950° C. inclusive.

The diffusion-coating process performed under the predetermined time and temperature conditions allows the alloy layer to have a controlled thickness, and allows the metallic structure of the iron component to grow. This structure thus provides an electromagnetic relay having high wear resistance and high corrosion resistance, as well as good magnetic properties.

In the electromagnetic relay according to embodiments of the present invention, the iron material may have a carbon content in a range of not less than 0 wt % and less than 0.15 wt %.

The iron material containing less carbon can be processed into an iron component having a sufficiently grown metallic structure in a magnetic component. This enables the magnetic component to have better magnetic properties.

In the electromagnetic relay according to embodiments of the present invention, the iron component may have a ferritic grain size of not more than 1 defined by JIS G0551 (2005).

The iron component has a large grain size and has a sufficiently grown metallic structure. This provides an electromagnetic relay having better magnetic properties.

EXAMPLES

Examples of the present invention will now be described. The examples may be modified variously without deviating from the scope of the present invention. In these examples, the maximum content of the element A may be referred to as the surface A concentration. For example, the maximum content of chrome in the alloy layer may be referred to as the surface chrome concentration. The at least one element distributes to decrease its amount gradually from the surface of the iron component toward the inside. The concentration is in wt %, although the unit of the concentration may hereafter be referred to as %.

Examples 1 to 5 and Comparative Examples 1 to 3

Figure 8A:
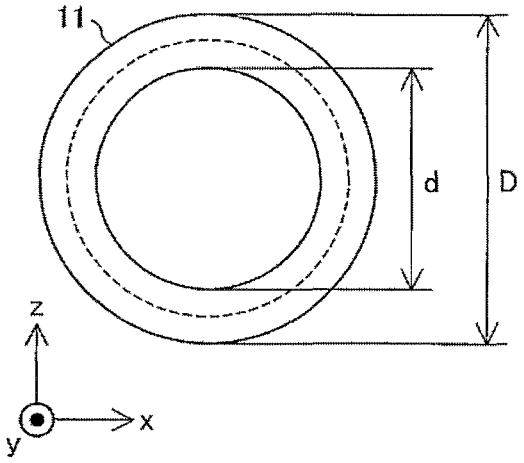
FIGS. 8A and 8B are schematic views showing the appearance of a test piece used in measuring coercive force in examples of the present invention.
Figure 8B:
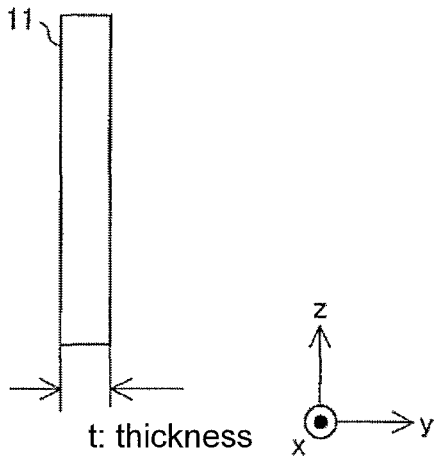

A yoke having a thickness of 1.5 mm, a width of 15 mm, and a length of 28 mm, and a ring having an outer diameter of 45 mm, an inner diameter of 33 mm, and a thickness of 1.2 mm were prepared using electromagnetic soft iron (SUYP) having a carbon content of 0.01 wt %. FIGS. 8A and 8B are schematic views showing the appearance of the ring. In FIG. 8A, D represents the outer diameter of the ring 11, and d represents the inner diameter of the ring 11. FIG. 8B shows the ring as viewed in x-direction in FIG. 8A. In FIG. 8B, t represents the thickness of the ring 11.

In examples 1 to 5 and comparative examples 1 and 2, the yokes and the rings prepared as described above underwent the diffusion-coating process under different temperature conditions to form test pieces. In the diffusion-coating process, the yokes and the rings were buried in a penetrant containing 40 to 80 wt % of chrome powder, 19.5 to 59.5 wt % of alumina powder, and 0.5 wt % of ammonium chloride powder in an incompletely sealed container. While the container is being supplied with hydrogen gas, the yokes and the rings were heated for 10 hours at 700° C. (comparative example 1), 750° C. (example 1), 800° C. (example 2), 850° C. (example 3), 900° C. (example 4), 950° C. (example 5), and 1000° C. (comparative example 2). In comparative example 3, the yokes and the rings plated with Ni were used as the test pieces. The yokes were used to examine the thickness of the alloy layer, the concentration of the at least one element used in diffusion-coating, the corrosion resistance, wear resistance, and attraction force to determine the effect of the diffusion-coating process in improving the quality of the components. The rings were used to test the coercive force.

Alloy Layer Thickness and Surface Chrome Concentration

Each yoke was cut, and the resultant cross-section was observed to measure the thickness of the alloy layer. The average of the measurement results at 10 positions was used as the thickness of the alloy layer. The surface chrome concentration was determined by element surface analysis with a scanning electron microscope (SEM) and by element concentration analysis with an electron probe micro analyzer (EPMA).

Surface Hardness of Alloy Layer

The surface hardness of the alloy layer was determined by measuring the Vickers hardness in accordance with JIS Z 2244 (1992). This test was conducted under a test load of 25 gf.

Corrosion Resistance Test (Salt-Spray Test)

A salt-spray test was used as a corrosion resistance test to determine the percentage of a corroded area on the surface of each test piece. In the salt-spray test tank maintained at 35° C., salt water with a salt concentration of 5±1% (mass ratio) and the pH of 6.5 to 7.2 (the water temperature of 20±2° C.) was continuously sprayed onto the test piece for 2 hours, and then the test piece was left in the tank for 20 to 22 hours. This single test cycle was repeated three times (three cycles). This corrosion resistance test was conducted in accordance with JIS C 0024 (2000) (IEC 60068-2-52 (1996)) and JIS C 5442 (1996).

Wear Resistance Test

In the wear resistance test, each test piece was actually mounted onto a relay. The relay was open and closed 20 million times, and then the appearance of the surface portion with metallic wear was observed. The metallic wear was evaluated based on the amount of the generated wear powder. The relay was open and closed 1800 times per minute. This wear resistance test was conducted in accordance with JIS C 4530 (1996), JIS C 5442 (1996), and NECA C 5440 (1999).

Attraction Force Test

Figure 9:
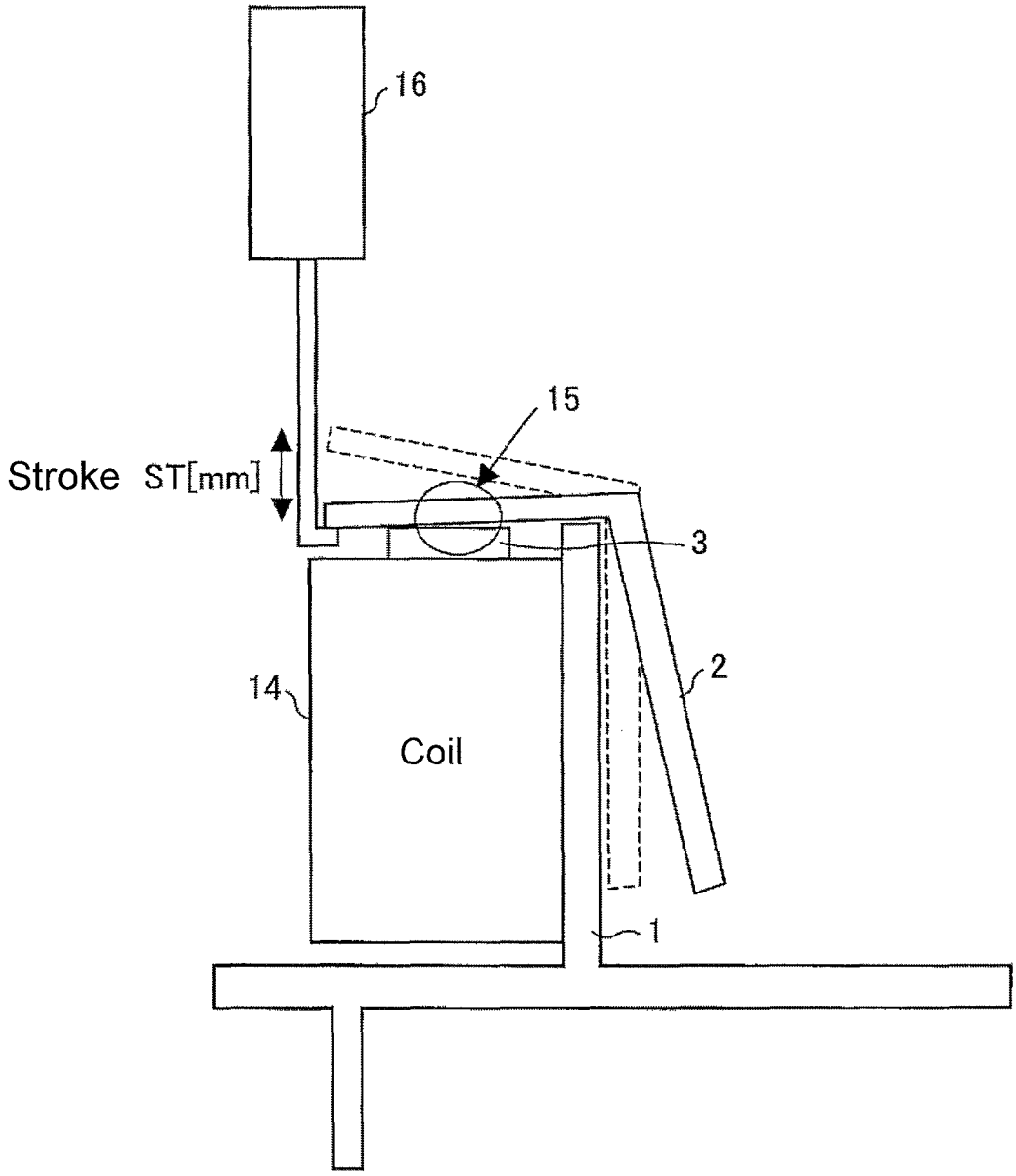
FIG. 9 is a schematic view illustrating a method for measuring attraction force in examples of the present invention.

FIG. 9 shows a device used in the attraction force test. For the attraction force test, the relay was prepared by using the yoke 1, the iron piece 2, and the iron core 3, which serve as the test pieces. In the test, the coil 14 wound around the iron core 3 was energized with a rated current supplied from an external power supply. The resultant attraction force generated in an electromagnet attracting area 15 was measured using a load cell 16.

Coercive Force Test

Figure 10A:
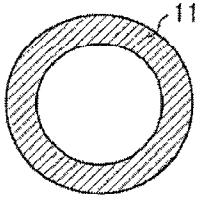
FIGS. 10A to 10E are schematic views illustrating a method for winding a coil around a test piece used in measuring coercive force in examples of the present invention.
Figure 10B:
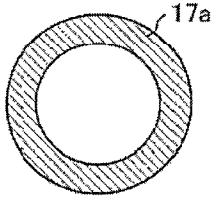
Figure 10C:
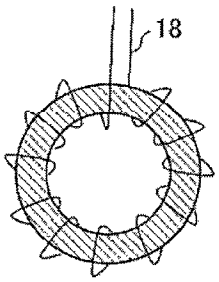
Figure 10D:
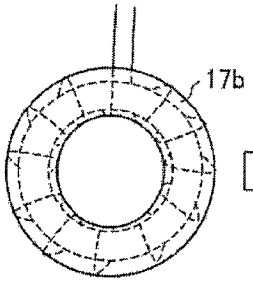
Figure 10E:
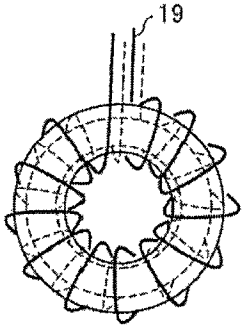
Figure 10F:
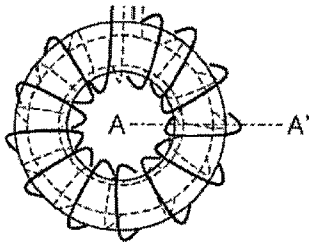
FIG. 10F is a schematic view showing the appearance of the test piece with the coil.
Figure 10G:
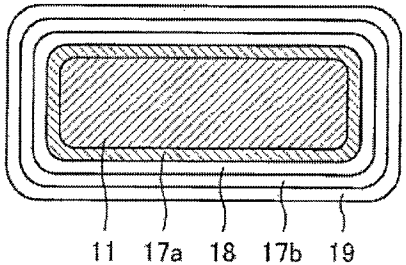
FIG. 10G is a cross-sectional view taken along line A-A' of FIG. 10F.

The coercive force of the circular ring, which was prepared as the test piece, was measured. FIGS. 10A to 10E illustrate a method for winding a coil around this test piece. The test piece 11 (FIG. 10A) is first covered with an insulation tape 17*a* (FIG. 10B). An insulated electrical conductor is then uniformly wound around the test piece 11 to form a magnetic flux detection coil 18 (FIG. 10C). An insulation tape 17*b* is wound around the test piece 11 (FIG. 10D). An insulated electrical conductor is wound around the test piece 11 by one or more layers over the insulation tape 17*b* to maximize the magnetic field. This prepares a magnetization coil 19 through which the largest magnetizing current will flow during the measurement (FIG. 10E). FIG. 10F is a schematic view showing the appearance of the test piece having the coil. FIG. 10G is a cross-sectional view taken along line A-A' of FIG. 10F. In this coercive force test, the coil for detecting the magnetic flux has a magnetic flux density of 100 T, and the magnetizing coil has a magnetic flux density of 200 T.

Figure 11:
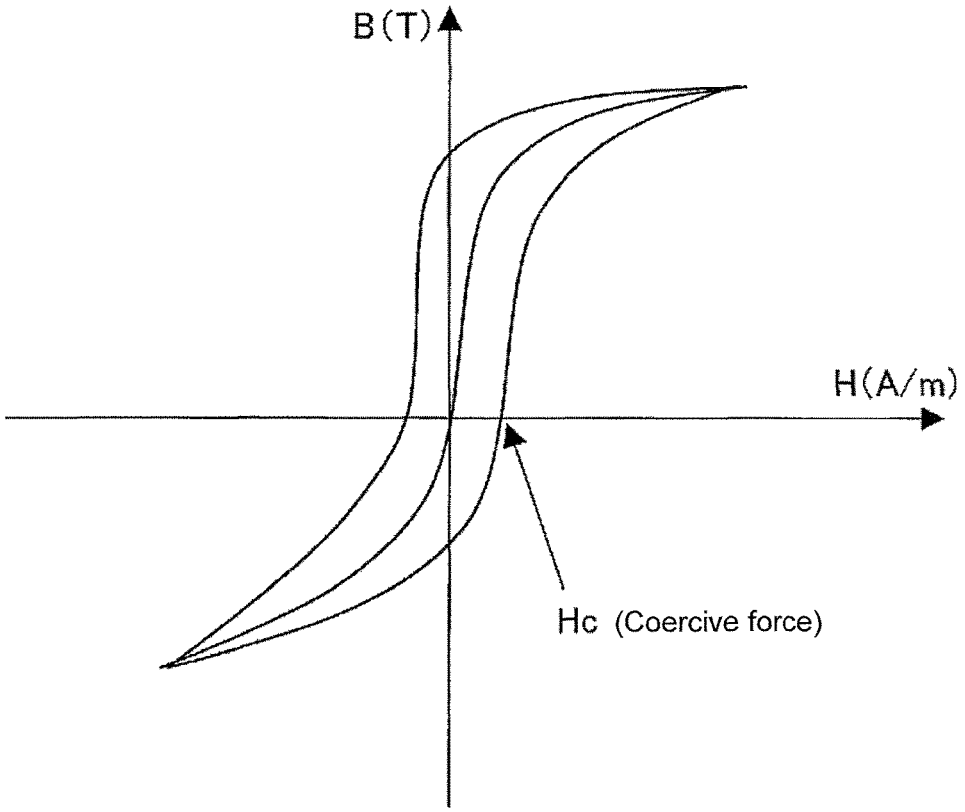
FIG. 11 is a graph showing examples of B-H curves used in measuring the coercive force.

The coercive force is the intensity of the reversing magnetic field to demagnetize a magnetized magnetic material. A smaller value of the coercive force indicates better magnetic properties. The coercive force was measured by using a B-H curve tracer. The coercive force values were determined from the measured B-H curves. FIG. 11 is a graph showing examples of such B-H curves. This measurement basically uses Initial magnetization curves. The coil was demagnetized after every measurement. The coercive force test was conducted in accordance with JIS C 2504 (2000).

Test Results for Examples 1 to 5 and Comparative Examples 1 to 3

Table 1 shows the test results for examples 1 to 5 and comparative examples 1 to 3. The results of the wear resistance test indicate the percentage of the amount of wear powder generated in each of the examples and each of the comparative examples when the amount of wear powder generated in comparative example 3 (Ni-plated product) is assumed to be 100%. A smaller value of the amount of wear powder indicates higher wear resistance. The results of the attraction force test indicate the percentage of the attraction force in each of the examples and each of the comparative examples when the attraction force in comparative example 3 is assumed to be 100%.

TABLE 1

| | Comparative Example 1 | Example 1 | Example 2 | Example 3 | Example 4 | Example 5 | Comparative Example 2 | Comparative Example 3 |
|---|---|---|---|---|---|---|---|---|
| Treatment Temperature (° C.) | 700 | 750 | 800 | 850 | 900 | 950 | 1000 | — |
| Thickness of Alloy Layer (μm) | 3 | 5 | 15 | 20 | 35 | 60 | 80 | 6 Ni-Plating Thickness |
| Surface Hardness of Alloy Layer (mHv) | 160 | 190 | 220 | 280 | 330 | 450 | 630 | 200, 230 |

TABLE 1-continued

| | Comparative Example 1 | Example 1 | Example 2 | Example 3 | Example 4 | Example 5 | Comparative Example 2 | Comparative Example 3 |
|---|---|---|---|---|---|---|---|---|
| Surface Chrome Concentration of Alloy Layer (%) | 15 | 22 | 29 | 37 | 46 | 61 | 78 | — |
| Corroded Surface Area after Corrosion Resistance Test (%) | 50-60 | 30-40 | 10-20 | 0 | 0 | 0 | 0 | 40-50 |
| Results of Wear Resistance Test | 110 | 100 | 90 | 80 | 70 | 60 | 50 | 100 |
| Attraction Force Characteristics (%) | 115 | 115 | 110 | 105 | 100 | 95 | 90 | 100 |
| Coercive Force (A/m) | 29.3 | 30.5 | 33.6 | 36.3 | 39.7 | 45.5 | 52.5 | 37.4 |

Results of Alloy Layer Surface Hardness

The alloy layer of chrome and iron is harder than the electromagnetic soft iron of the base material (with a Vickers hardness of 90 to 150 mHv), and has a Vickers hardness of 160 to 630 mHv as shown in Table 1. The alloy layer in comparative example 1 has a Vickers hardness of 160 mHv, which is lower than that of comparative example 3. The thickness of the alloy layer in comparative example 1 is 3 μm, which is thin.

Results of Corrosion Resistance Test

Although comparative example 1 shows a larger corroded area of 50 to 60% indicating more corrosion than the Ni-plated product of comparative example 3 with the corroded area of 40 to 50%, examples 1 to 5 all show less corrosion than comparative example 3. In particular, examples 3 to 5 (with an alloy layer thickness of 20 to 60 μm and a chrome concentration of 37 to 61 wt %) show no corrosion. These results indicate that a thicker alloy layer with a higher chrome concentration provides higher corrosion resistance. Also, the alloy layer with a controlled thickness will improve the corrosion resistance without degrading the magnetic properties, although the coating uses Cr, which is an antiferromagnetic substance, instead of Ni, which is a ferromagnetic substance.

Results of Wear Resistance Test

Although the wear resistance in comparative example 1 is lower than that of the Ni-plated product of comparative example 3, the wear resistance in examples 1 to 5 and comparative example 2 is equivalent to or exceeds the wear resistance in comparative example 3. In particular, examples 3 to 5 with a high Vickers hardness shows almost no wear.

Results of Wear Resistance Test

Although the use of chrome, which is an antiferromagnetic material, for forming the alloy layer could lower the magnetic properties, the attraction force in comparative examples 1 and 2 and examples 1 to 5 is higher than or equivalent to that obtained in comparative example 3 when the alloy layer has a thickness of not more than 60 μm as shown in Table 1. However, the attraction force in comparative example 2 (with an alloy layer thickness of 80 μm) is too low to use this test piece for a magnetic component.

Figure 12:
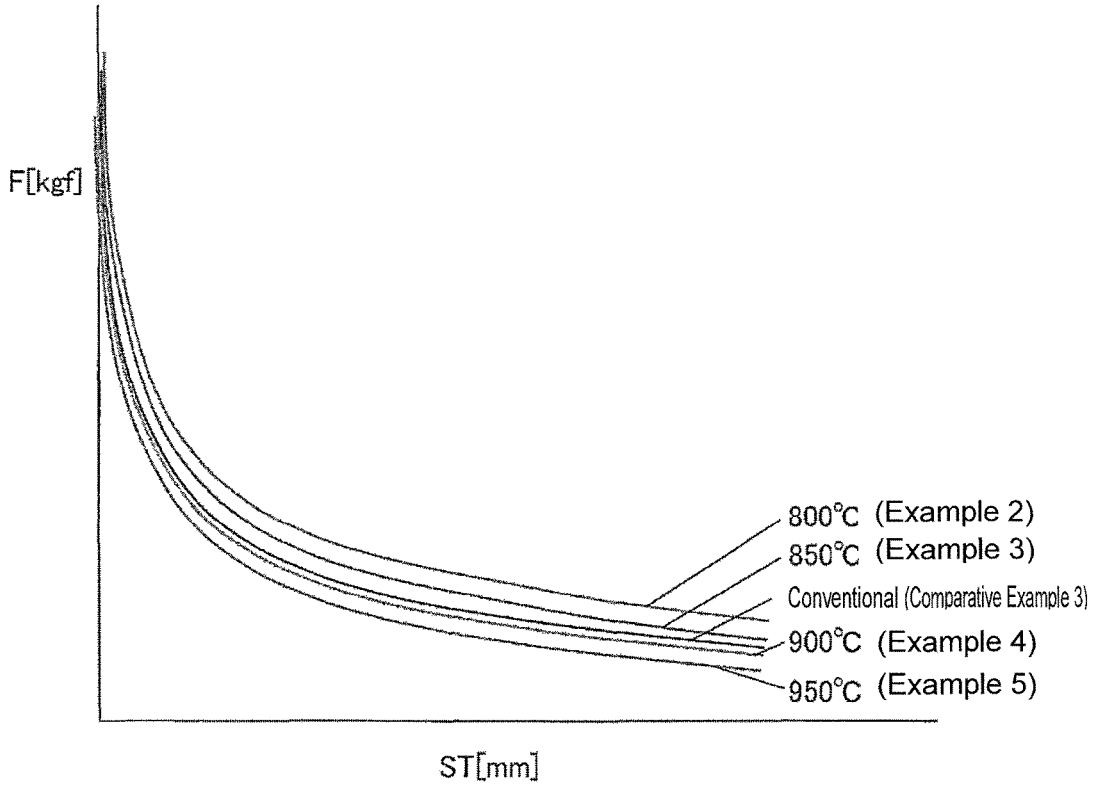
FIG. 12 is a graph showing the relationship between the stroke ST and the attraction force F in examples of the present invention.

FIG. 12 is a graph showing the relationship between the stroke ST (mm) and the attraction force F. The attraction force obtained in example 4 (with a treatment temperature of 900° C.) is equivalent to that of comparative example 3. The results indicate that the attraction force decreases as the treatment temperature increases, and the attraction force increases as the treatment temperature increases.

Results of Coercive Force Test

In the coercive force test, the coercive force obtained in comparative example 1 and examples 1 to 5 is equivalent to or better than that of comparative example 3 shown in Table 1 when the alloy layer has a thickness of not more than 50 μm. When the coercive force is within the range of +10 Nm from the coercive force of comparative example 3, the test piece is determined usable for a magnetic component. The coercive force in comparative example 2 (with an alloy layer thickness of 80 μm) is too poor to use this test piece for a magnetic component.

Figure 13A:
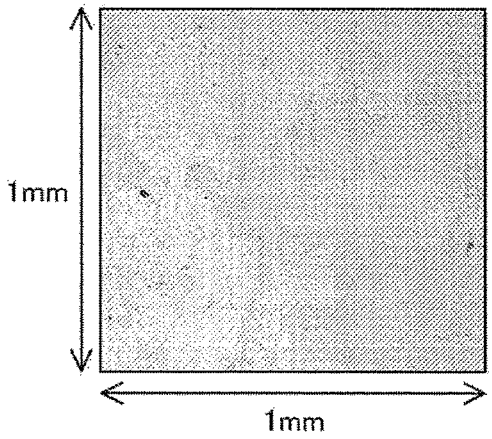
FIGS. 13A to 13D are diagrams showing metallic structures obtained in examples of the present invention.
Figure 13B:
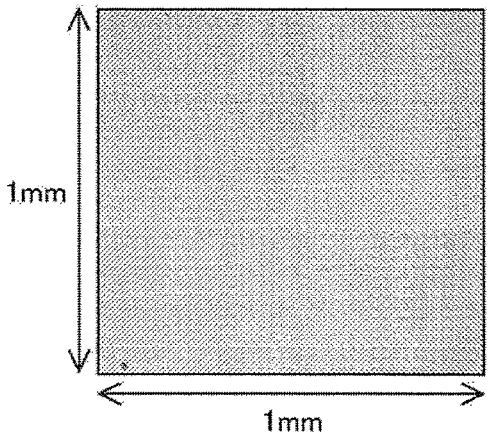
Figure 13C:
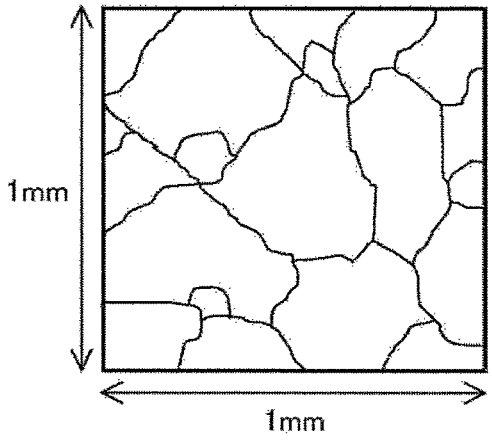
Figure 13D:
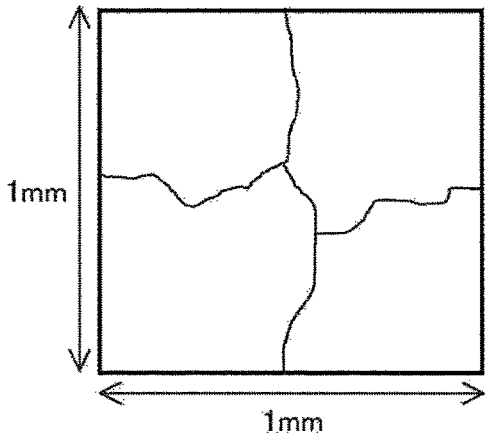

With the heating temperature (800 to 900° C.) and the treatment time (15 to 30 minutes) used conventionally for Ni-plating to improve the magnetic properties, the ferritic grain size of the base material is not less than 2 defined in JIS G0551 (2005) (not more than about 32 crystal grains per square millimeter of the cross-section: refer to FIG. 13A). With the heating temperature of 750 to 950° C. and the treatment time of as long as 10 hours used in examples 1 to 5, the crystal grain size increases, and the ferritic grain size is not more than −1 (not more than about 4 crystal gains per square millimeter of the cross-section: refer to FIG. 13B). FIGS. 13C and 13D show the grain boundaries of FIGS. 13A and 13B in an enlarged and emphasized manner.

The alloy layer having a thickness of not more than 60 μm (examples 1 to 5 and comparative example 1) provides good magnetic properties when the ferritic grain size is not more than −1. For the alloy layer having a thickness reaching 80 μm (comparative example 2), the magnetic properties deteriorate even with the diffusion-coating process performed under the heating conditions that can maximize the grain size of the base material, or specifically at 1000° C. for 10 hours.

Examples 1 to 5 and Comparative Examples 1 to 6

NSSMAG1 (soft magnetic stainless steel) (comparative examples 4 to 5) and SUYP (electromagnetic soft iron) (comparative example 6) also underwent the coercive force test described above. The results were compared with those of chromized SUYP (examples 1 to 5 and comparative examples 1 and 2) and Ni-plated SUYP (comparative example 3). Table 2 shows the test results.

TABLE 2

| | Steel Type | Annealing Temperature | Coercive Force Hc (A/m) |
|---|---|---|---|
| Comparative Example 4 | NSSMAG1 | 850° C. for 2 hours | 81.7 |
| Comparative Example 5 | | 960° C. for 2 hours | 35.3 |
| Comparative Example 6 | SUYP (Electromagnetic soft iron) | 850° C. for 1 hour | 31.8 |
| Comparative Example 3 | SUYP + Ni-plating | 850° C. for 1 hour | 37.4 |
| Comparative Example 1 | SUYP + Chromizing | 700° C. for 10 hours | 29.3 |
| Example 1 | | 750° C. for 10 hours | 30.5 |

TABLE 2-continued

| Steel Type | Annealing Temperature | Coercive Force Hc (A/m) |
|---|---|---|
| Example 2 | 800° C. for 10 hours | 33.6 |
| Example 3 | 850° C. for 10 hours | 36.3 |
| Example 4 | 900° C. for 10 hours | 39.7 |
| Example 5 | 950° C. for 10 hours | 45.5 |
| Comparative Example 2 | 1000° C. for 10 hours | 52.5 |

As shown in Table 2, the coercive force value is larger for comparative example 3 with Ni-plating than for comparative example 6 with no Ni-plating. Among the examples using chromizing, the coercive force of examples 1 and 2 is better than that of comparative examples 4 and 5, in which the test pieces contain chrome uniformly.

Example 6

A yoke prepared by processing low-carbon steel (SPCC with a carbon content of 0.01 wt %) (with maximum lengths of 22 mm in z-direction and 11 mm in x-direction and a width, or length in y-direction, of 11.5 mm in FIG. 5) underwent the diffusion-coating process under the conditions below:

Penetrant composition: chrome powder (40 wt %), alumina powder (59.5 wt %), and ammonium chloride powder (0.5 wt %)

Treatment temperature: 800° C.

Treatment time: 5 hours

Figure 14A:
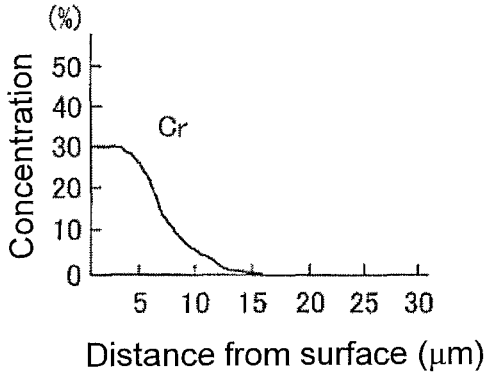
FIG. 14A is a graph showing chrome concentration analysis values measured at the cross-section of an alloy layer in example 6 of the present invention.

The resultant yoke includes an alloy layer with a thickness of 15 μm and a surface chrome concentration of 30%. FIG. 14A is a graph showing the chrome concentration analysis values measured at the cross-section of the alloy layer with an EPMA.

The yoke then underwent the tests for the magnetic properties (the attraction force test and the coercive force test), the corrosion resistance test, and the wear resistance test in the same manner as in example 1. Like the conventional Ni-plated product (comparative example 3), this yoke has good magnetic properties. The corroded area in this yoke determined in the corrosion resistance test is 10 to 20%, which is lower than in comparative example 3 (40 to 50%), demonstrating the advantageous effect of the present invention. In the wear resistance test, the yoke was mounted on a relay, and the relay was open and closed 20 million times. After this wear resistance test, the sliding surface of the yoke showed almost no wear, indicating good resistance.

Example 7

A yoke prepared by processing low-carbon steel (SPCC with a carbon content of 0.01 wt %) (with maximum lengths of 22 mm in z-direction and 11 mm in x-direction and a width, or length in y-direction, of 11.5 mm in FIG. 5) underwent the diffusion-coating process under the conditions below:

Penetrant composition: ferrovanadium powder (50 wt %), alumina powder (49.5 wt %), and ammonium chloride powder (0.5 wt %)

Treatment temperature: 930° C.

Treatment time: 5 hours

Figure 14B:
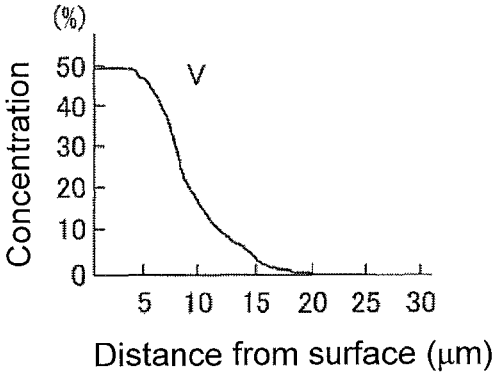
FIG. 14B is a graph showing vanadium concentration analysis values measured at the cross-section of an alloy layer in example 7 of the present invention.

The resultant yoke includes an alloy layer with a thickness of 20 μm and a surface vanadium concentration of 49%. FIG. 14B is a graph showing the vanadium concentration analysis values measured at the cross-section of the alloy layer with an EPMA.

The yoke then underwent the magnetic properties tests, the corrosion resistance test, and the wear resistance test in the same manner as in example 1. This yoke has good magnetic properties, like in comparative example 3. In the corrosion resistance, no corrosion was observed. This shows corrosion resistance far higher than that of comparative example 3 (40 to 50%), demonstrating the advantageous effect of the present invention. In the wear resistance test, the yoke was mounted on a relay, and the relay was open and closed 20 million times. After this wear resistance test, the sliding surface of the yoke showed almost no wear, indicating high wear resistance.

Example 8

A yoke prepared by processing low-carbon steel (SPCC with a carbon content of 0.01 wt %) (with maximum lengths of 22 mm in z-direction and 11 mm in x-direction and a width, or length in y-direction, of 11.5 mm in FIG. 5) underwent the diffusion-coating process under the conditions below:

Penetrant composition: iron-aluminum alloy powder (65 wt %), alumina powder (34.5 wt %), and ammonium chloride powder (0.5 wt %)

Treatment temperature: 830° C.

Treatment time: 5 hours

Figure 14C:
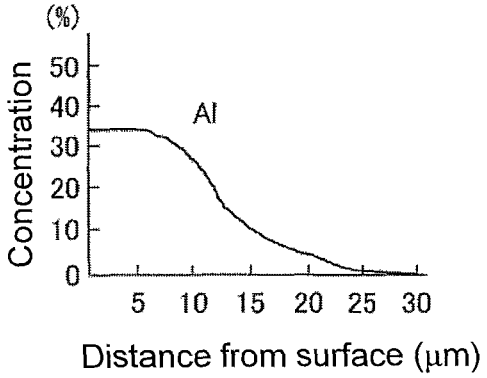
FIG. 14C is a graph showing aluminum concentration analysis values measured at the cross-section of an alloy layer in example 8 of the present invention.

The resultant yoke includes an alloy layer having a thickness of 30 μm and a surface aluminum concentration of 33%. FIG. 14C is a graph showing the chrome concentration analysis values measured at the cross-section of the alloy layer with an EPMA.

The yoke then underwent the magnetic properties tests, the corrosion resistance test, and the wear resistance test in the same manner as in example 1. This yoke has good magnetic properties, like in comparative example 3. In the corrosion resistance, no corrosion was observed. This shows corrosion resistance far higher than that of comparative example 3 (40 to 50%), demonstrating the advantageous effect of the present invention. In the wear resistance test, the yoke was mounted on a relay, and the relay was open and closed 20 million times. After this wear resistance test, the sliding surface of the yoke showed almost no wear, indicating high wear resistance.

Example 9

A yoke prepared by processing low-carbon steel (SPCC with a carbon content of 0.01 wt %) (with maximum lengths of 22 mm in z-direction and 11 mm in x-direction and a width, or length in y-direction, of 11.5 mm in FIG. 5) underwent the diffusion-coating process under the conditions below:

Penetrant composition: chrome powder (40 wt %), alumina powder (59.5 wt %), and ammonium chloride powder (0.5 wt %)

Treatment temperature: 800° C.

Treatment time: 13 hours

Figure 15A:
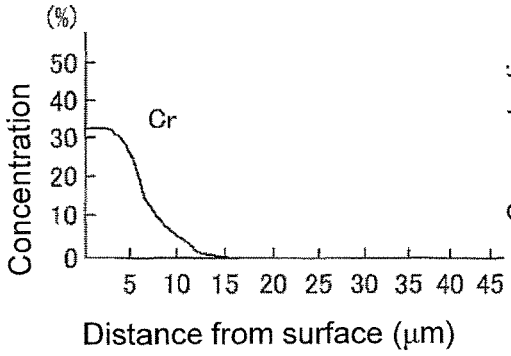
FIGS. 15A to 15C are graphs showing chrome concentration analysis values measured at the cross-sections of an alloy layer in examples 9 to 11 of the present invention.

The resultant yoke includes an alloy layer having a thickness of 15 μm, a surface hardness of 270 mHv, and a surface chrome concentration of 33%. FIG. 15A is a graph showing the chrome concentration analysis values measured at the cross-section of the alloy layer with an EPMA.

The yoke then underwent the tests for the magnetic properties (the attraction force test and the coercive force test), the corrosion resistance test, and the wear resistance test in the same manner as in example 1. Like the conventional Ni-plated product (comparative example 3), this yoke has good magnetic properties. The corroded area in this yoke determined in the corrosion resistance test is 10 to 20%, which is lower than in comparative example 3 (40 to 50%), demonstrating the advantageous effect of the present invention. In the wear resistance test, the yoke was mounted on a relay, and the relay was open and closed 20 million times. After this wear resistance test, the sliding surface of the yoke showed almost no wear, indicating good resistance.

Example 10

An iron piece prepared by processing low-carbon steel (SPCC with a carbon content of 0.12 wt %) (with maximum lengths of 13.5 mm in x-direction and 8.5 mm in z-direction and a width, or length in y-direction, of 11.5 mm in FIG. 5) underwent the diffusion-coating process under the conditions below:

Penetrant composition: chrome powder (40 wt %), alumina powder (59.5 wt %), and ammonium chloride powder (0.5 wt %)

Treatment temperature: 880° C.

Treatment time: 8 hours

Figure 15B:
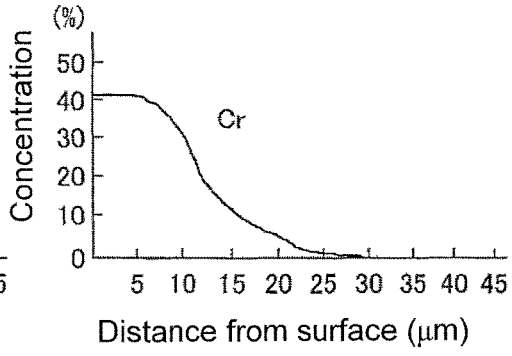

The resultant iron piece has an alloy layer having a thickness of 29 μm, a surface hardness of 310 mHv, and a surface chrome concentration of 42%. FIG. 15B is a graph showing the chrome concentration analysis values measured at the cross-section of the alloy layer with an EPMA.

The iron piece then underwent the tests for the magnetic properties (the attraction force test and the coercive force test), the corrosion resistance test, and the wear resistance test in the same manner as in example 1. Like the conventional Ni-plated product (comparative example 3), the iron piece has good magnetic properties. In the corrosion resistance test, no corrosion was observed. This shows corrosion resistance far higher than that of comparative example 3 (40 to 50%), demonstrating the advantageous effect of the present invention. In the wear resistance test, the iron piece was mounted on a relay, and the relay was open and closed 20 million times. After this wear resistance test, the sliding surface of the iron piece showed almost no wear, indicating high wear resistance.

Example 11

An iron core prepared by processing low-carbon steel (SPCC with a carbon content of 0.07 wt %) (with a diameter of ϕ7 mm and a maximum length of 20.5 mm) underwent the diffusion-coating process under the conditions below:

Penetrant composition: chrome powder (40 wt %), alumina powder (59.5 wt %), and ammonium chloride powder (0.5 wt %)

Treatment temperature: 930° C.

Treatment time: 6 hours

Figure 15C:
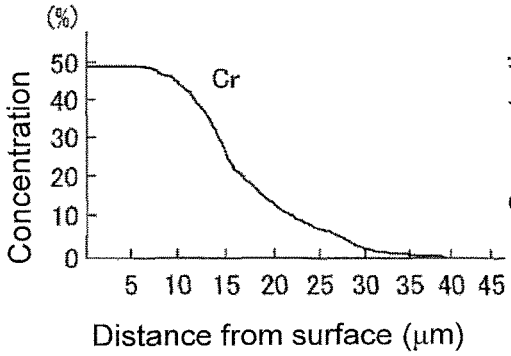

The resultant iron core has an alloy layer having a thickness of 38 μm, a surface hardness of 360 mHv, and a surface chrome concentration of 49%. FIG. 15C is a graph showing the chrome concentration analysis values measured at the cross-section of the alloy layer with an EPMA.

The iron core then underwent the tests for the magnetic properties (the attraction force test and the coercive force test), the corrosion resistance test, and the wear resistance test in the same manner as in example 1. Like the conventional Ni-plated product (comparative example 3), this iron core has good magnetic properties. The corroded area in this iron core determined in the corrosion resistance test is 10 to 20%. This shows corrosion resistance far higher than that of comparative example 3 (40 to 50%), demonstrating the advantageous effect of the present invention. In the wear resistance test, the iron core was mounted on a relay, and the relay was open and closed 20 million times. After this wear resistance test, the sliding surface of the iron core showed almost no wear, indicating high wear resistance.

Example 12

An iron core prepared by processing low-carbon steel (SPCC with a carbon content of 0.01 wt %) (with a diameter of ϕ7 mm and a maximum length of 20.5 mm) underwent the diffusion-coating process under the conditions described below:

Penetrant composition: ferrovanadium powder (50 wt %), alumina powder (49.5 wt %), and ammonium chloride powder (0.5 wt %)

Treatment temperature: 930° C.

Treatment time: 7 hours

Figure 15D:
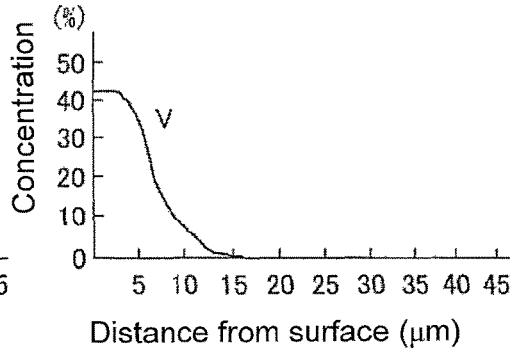
FIG. 15D is a graph showing vanadium concentration analysis values measured at the cross-section of an alloy layer in example 12 of the present invention.

The resultant iron core has an alloy layer having a thickness of 16 μm, a surface hardness of 410 mHv, and a surface vanadium concentration of 43%. FIG. 15D is a graph showing the vanadium concentration analysis values measured at the cross-section of the alloy layer with an EPMA.

The iron core then underwent the magnetic properties tests, the corrosion resistance test, and the wear resistance test in the same manner as in example 1. This iron core has good magnetic properties, like in comparative example 3. In the corrosion resistance, no corrosion was observed. This shows corrosion resistance far higher than that of comparative example 3 (40 to 50%), demonstrating the advantageous effect of the present invention. In the wear resistance test, the iron core was mounted on a relay, and the relay was open and closed 20 million times. After this wear resistance test, the sliding surface of the iron core showed almost no wear, indicating high wear resistance.

Example 13

An iron piece prepared by processing low-carbon steel (SPCC with a carbon content of 0.10 wt %) (with maximum lengths of 13.5 mm in x-direction and 8.5 mm in z-direction and a width, or length in the y-direction, of 11.5 mm in FIG. 5 underwent the diffusion-coating process under the conditions described below:

Penetrant composition: iron-aluminum alloy powder (65 wt %), alumina powder (34.5 wt %), and ammonium chloride powder (0.5 wt %)

Treatment temperature: 800° C.

Treatment time: 5 hours

Figure 15E:
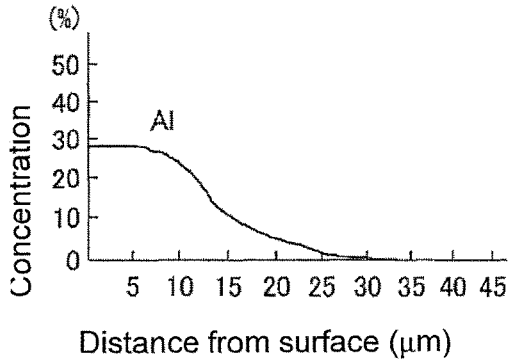
FIG. 15E is a graph showing aluminum concentration analysis values measured at the cross-section of an alloy layer in example 13 of the present invention.
Figure 16A:
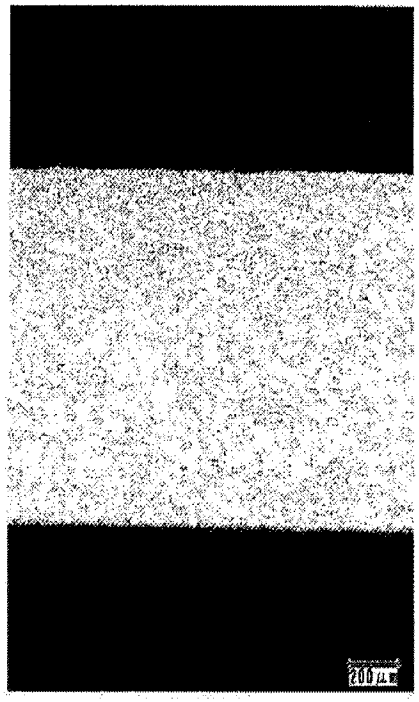
FIGS. 16A to 16C are graphs showing the test results of example 14 of the present invention and comparative examples 7 and 8.
Figure 16B:
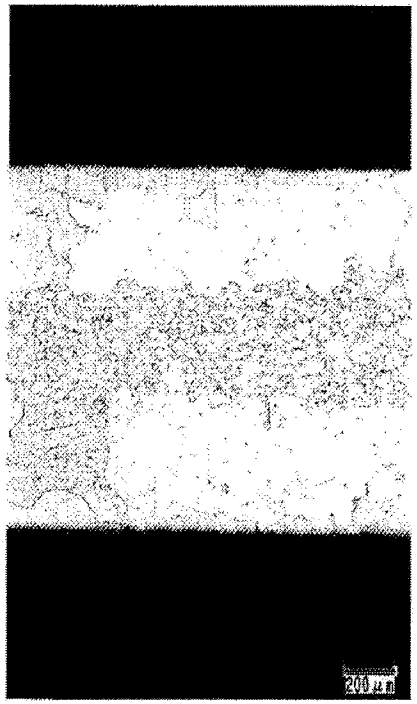
Figure 16C:
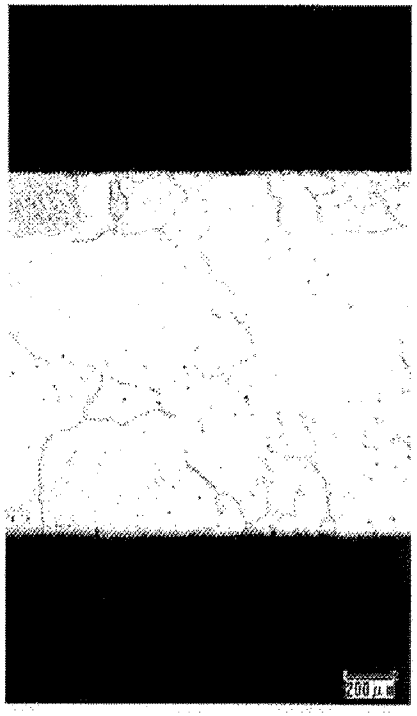
Figure 17:
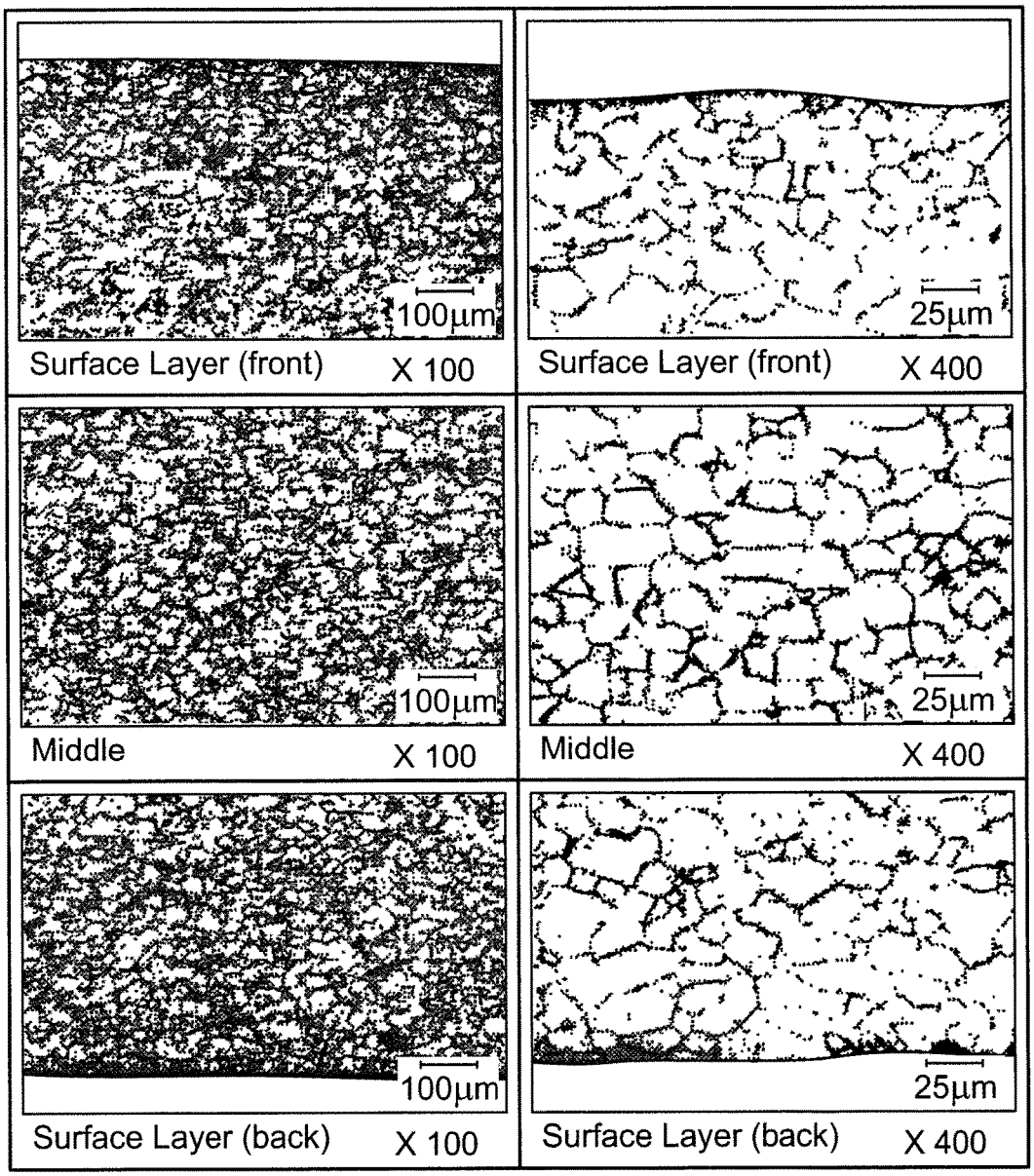
FIG. 17 is a diagram showing the test results of comparative example 7.
Figure 18:
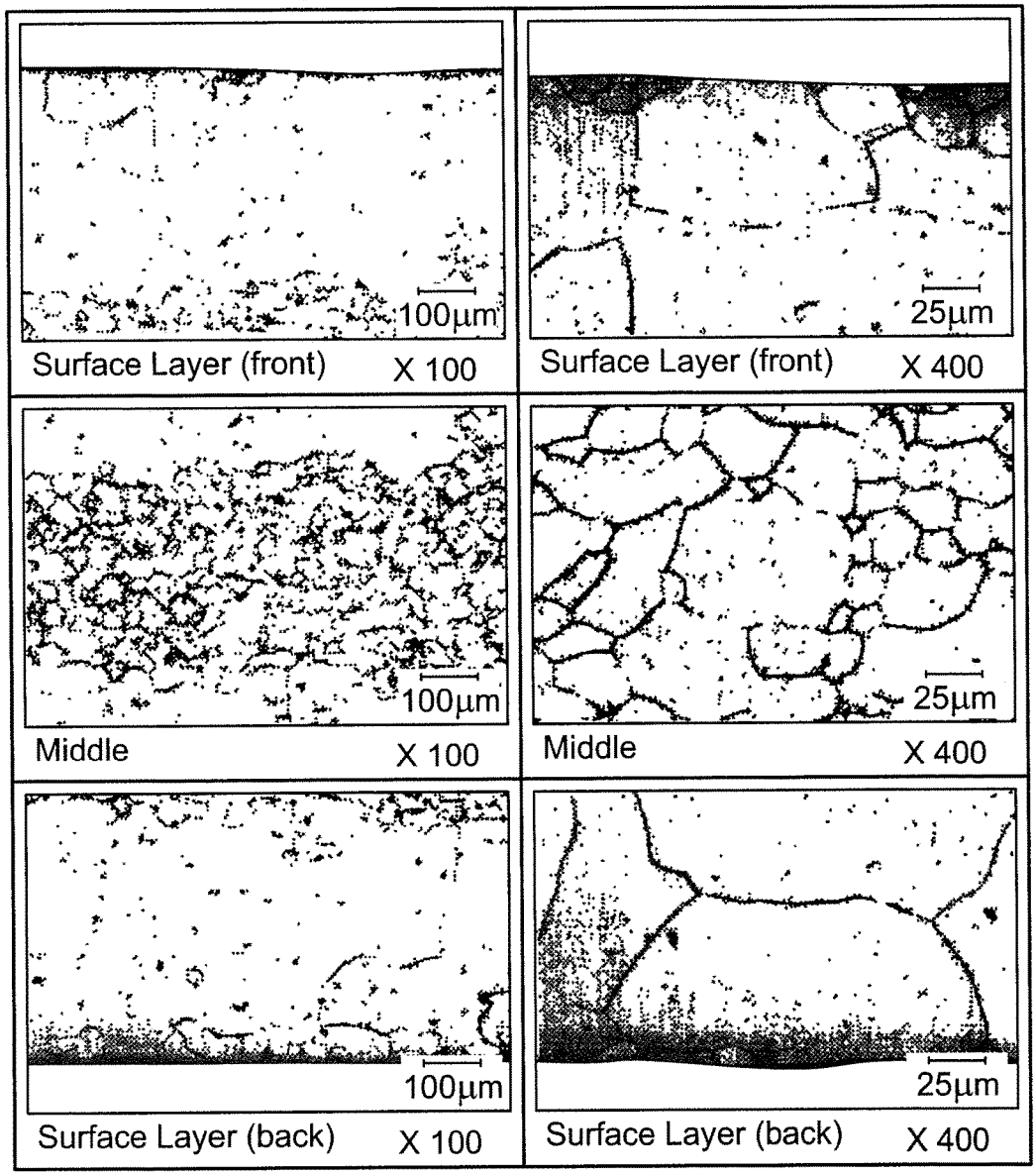
FIG. 18 is a diagram showing the test results of comparative example 8.
Figure 19:
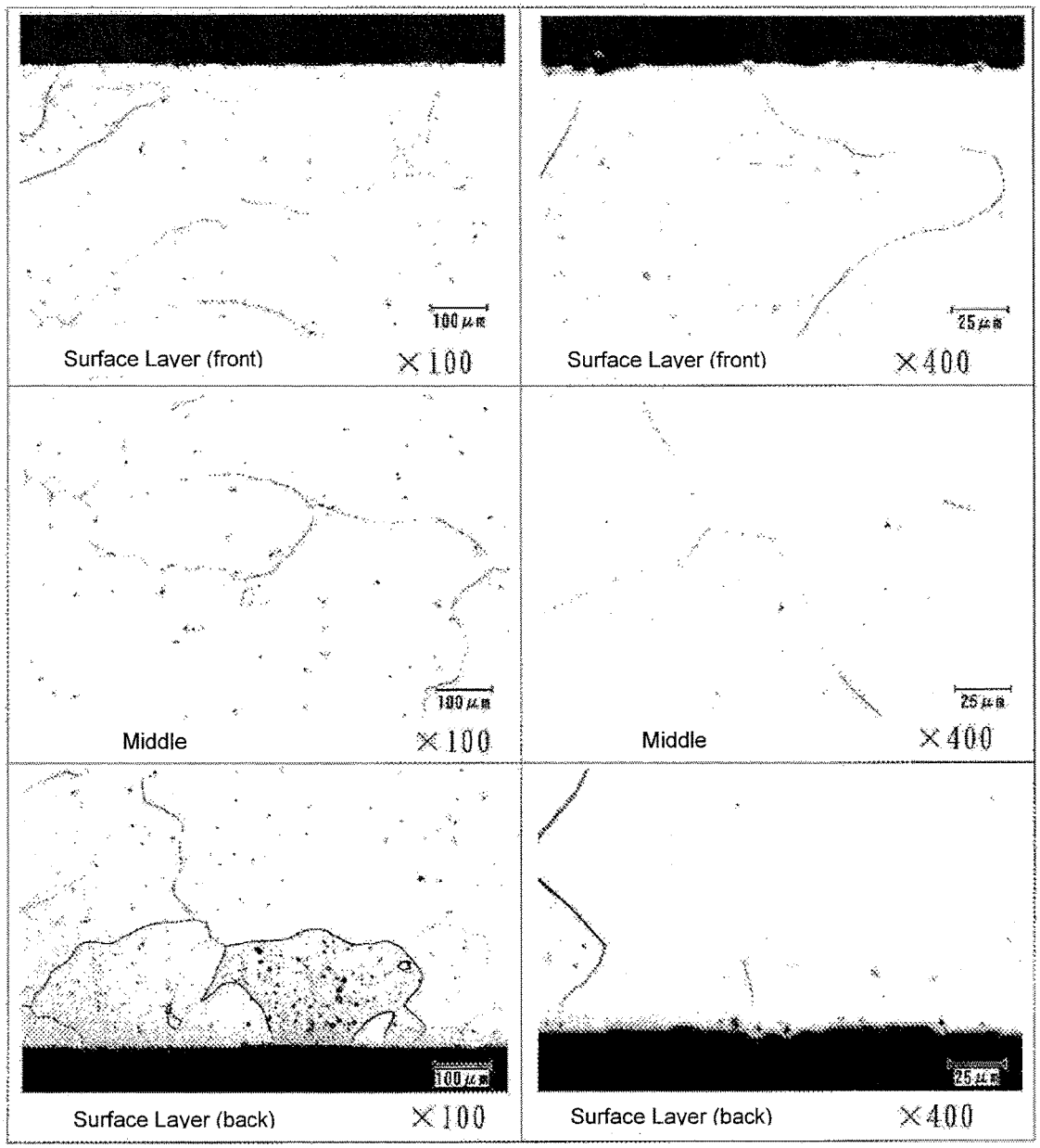
FIG. 19 is a diagram showing the test results of example 14 of the present invention.
Figure 20A:
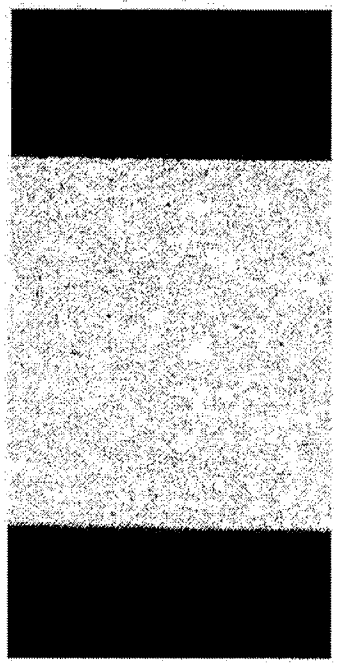
FIGS. 20A to 20C are diagrams showing the test results of example 15 of the present invention and comparative examples 9 and 10.
Figure 20B:
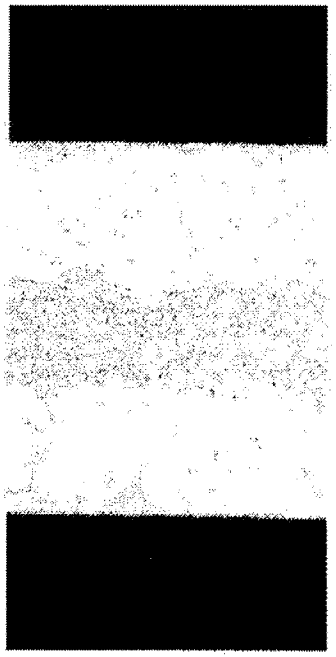
Figure 20C:
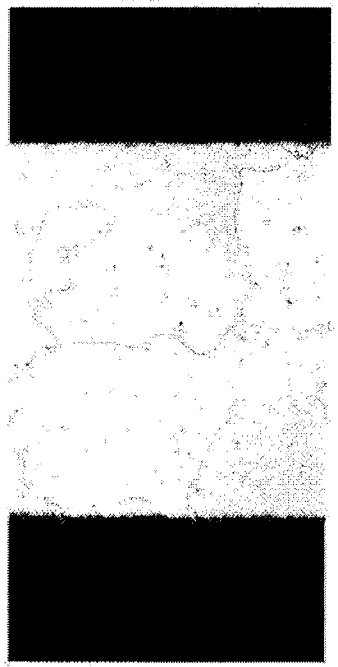
Figure 21:
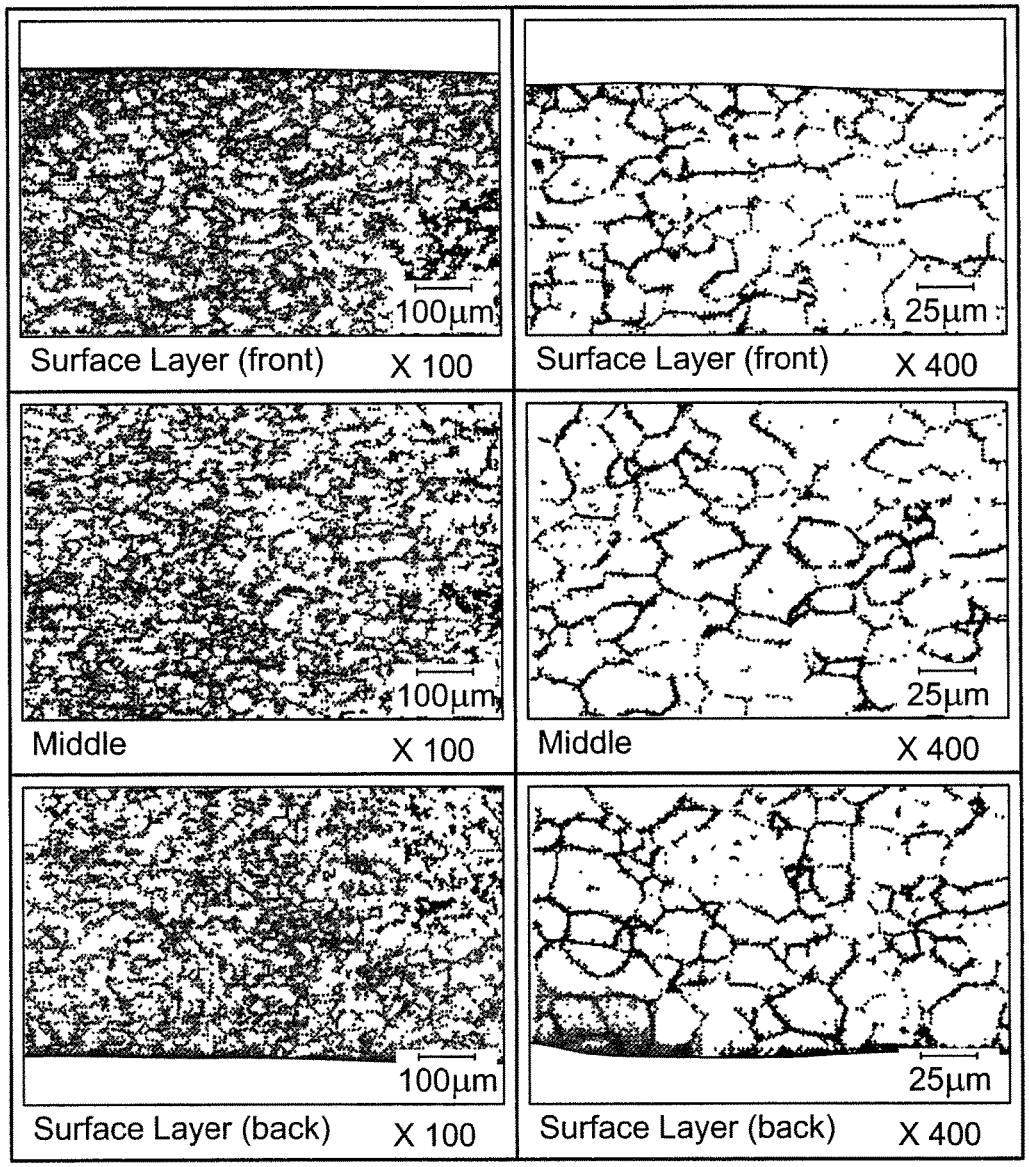
FIG. 21 is a diagram showing the test results of comparative example 9.
Figure 22:
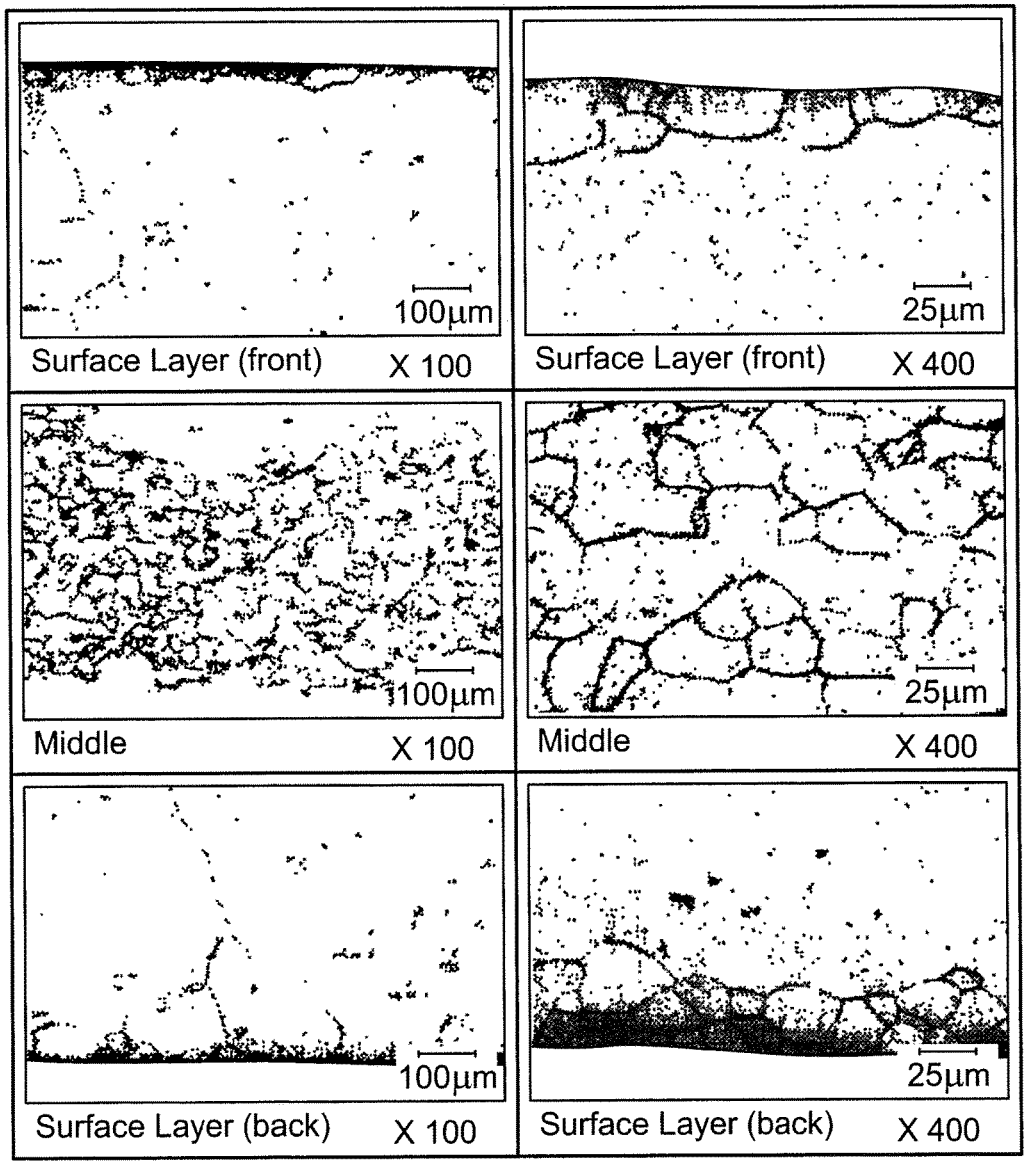
FIG. 22 is a diagram showing the test results of comparative example 10.
Figure 23:
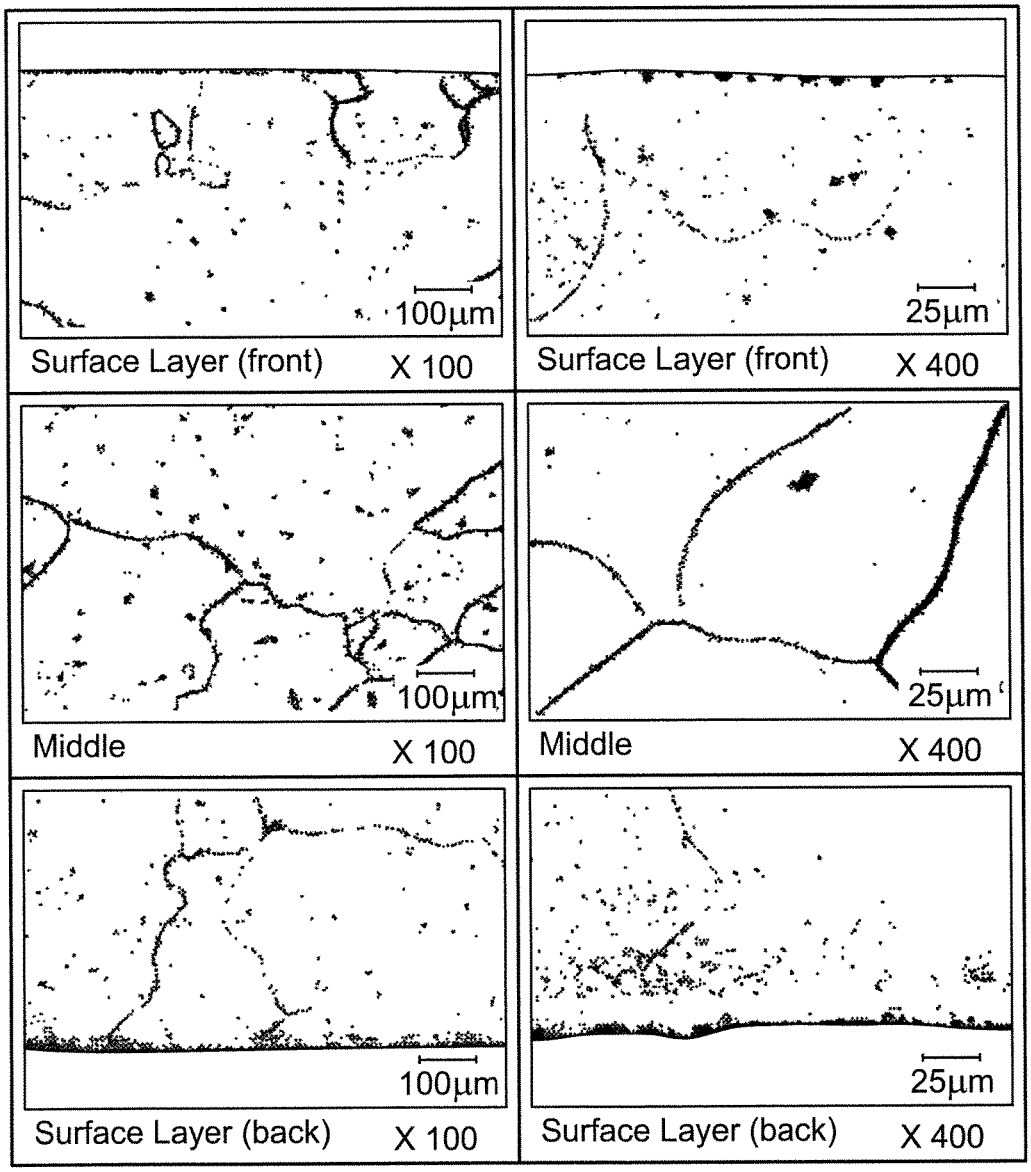
FIG. 23 is a diagram showing the test results of example 15 of the present invention.

The resultant iron piece has an alloy layer having a thickness of 31 μm, a surface hardness of 250 mHv, and a surface aluminum concentration of 29%. FIG. 15E is a graph showing the aluminum concentration analysis values measured at the cross-section of the alloy layer with an EPMA.

The iron piece then underwent the tests for the magnetic properties, the corrosion resistance test, and the wear resistance test in the same manner as in example 1. The iron piece has good magnetic properties, like in comparative example 3. In the corrosion resistance test, no corrosion was observed. This shows corrosion resistance far higher than that of comparative example 3 (40 to 50%), demonstrating the advantageous effect of the present invention. In the wear resistance test, the iron piece was mounted on a relay, and the relay was open and closed 20 million times. After this wear resistance test, the sliding surface of the iron piece showed almost no wear, indicating high wear resistance.

The results in examples 6 to 13 indicate that the alloy layer with a controlled thickness will improve the corrosion resistance without degrading the magnetic properties when the coating uses Cr, V, or Al, which is either an antiferromagnetic substance, a diamagnetic or paramagnetic substance, instead of Ni, which is a ferromagnetic substance.

Examples 14 and 15 and Comparative Examples 7 to 10

The metallic structure of the test pieces prepared by processing SPCC was observed. The test pieces used in example 14 and comparative examples 7 and 8 have a thickness of 1.2 mm. The test pieces used in example 15 and comparative examples 9 and 10 have a thickness of 1.6 mm. In examples 14 and 15, the test pieces were treated at 840° C. for 9 hours using a penetrant (40 wt % of chrome powder, 59.5 wt % of alumina powder, and 0.5 wt % of ammonium chloride powder) to form an alloy layer. In comparative examples 7 and 9, no heat treatment was performed. In comparative examples 8 to 10, heat treatment at 850° C. was performed. In comparative examples 7 to 10, no diffusion-coating nor Ni plating was performed.

FIGS. 16 to 19 are cross-sectional views of the test pieces in example 14 and comparative examples 7 and 8 with different magnifications. FIGS. 20A to 23 are cross-sectional views of the test pieces in example 15 and comparative examples 9 and 10 with different magnifications. As shown in FIGS. 16 to 23, the test pieces of examples 14 and 15 have metallic structures grown more than those of comparative examples 7 to 10.

Examples 16 to 19 and Comparative Example 11

Yokes prepared by processing pure iron underwent the salt-spray test in the same manner as in example 1. The yokes used in examples 16 to 19 were chromized using a penetrant (40 wt % of chrome powder, 59.5 wt % of alumina powder, and 0.5 wt % of ammonium chloride powder) with the treatment time of 8 hours at different treatment temperatures: 765° C. in example 16; 800° C. in example 17; 850° C. in example 18; and 950° C. in example 19. The yokes used in comparative example 11 were plated with Ni. Three yokes were prepared for each of the examples and the comparative examples.

Figure 24:
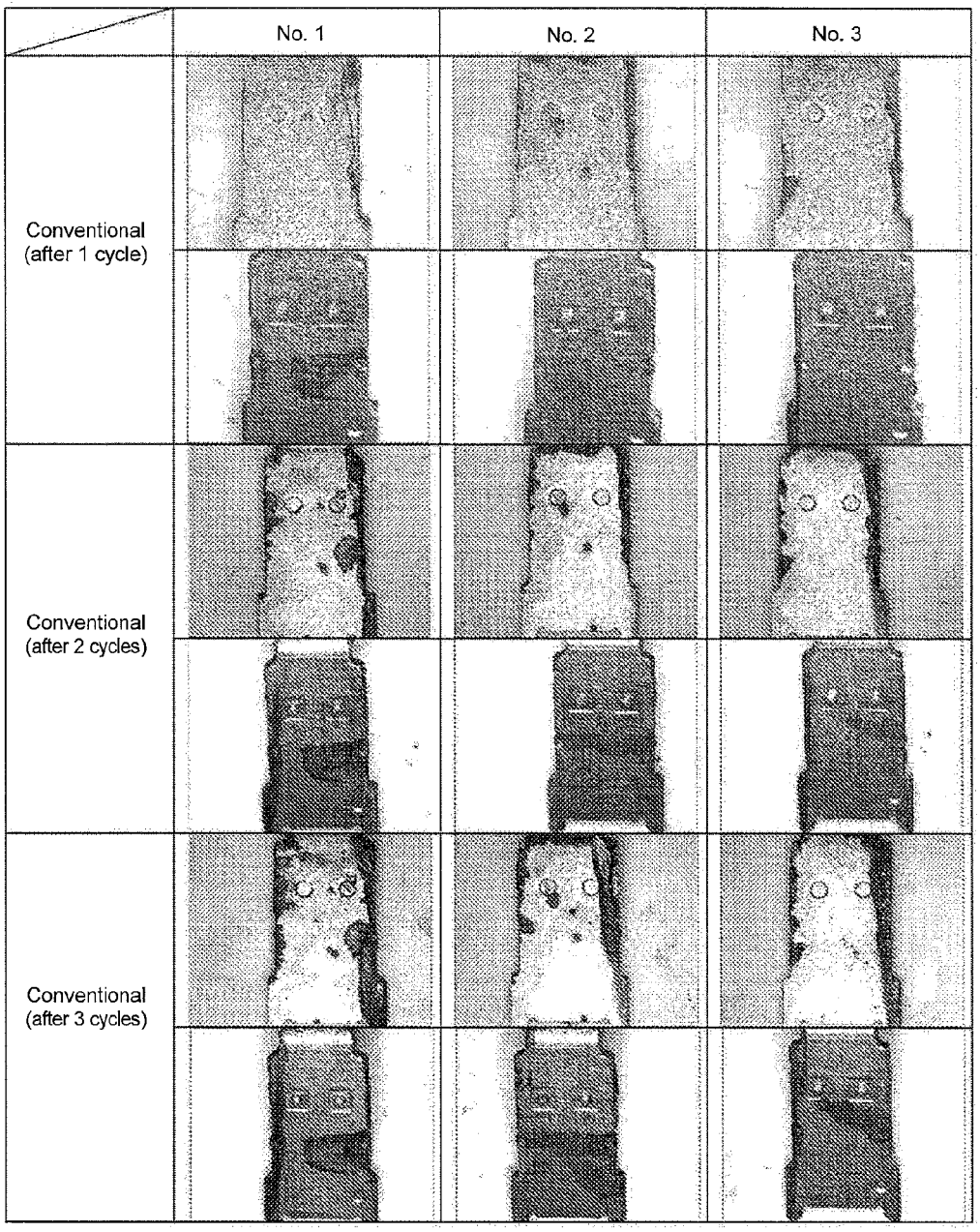
FIG. 24 is a diagram showing the test results of comparative example 11.
Figure 25:
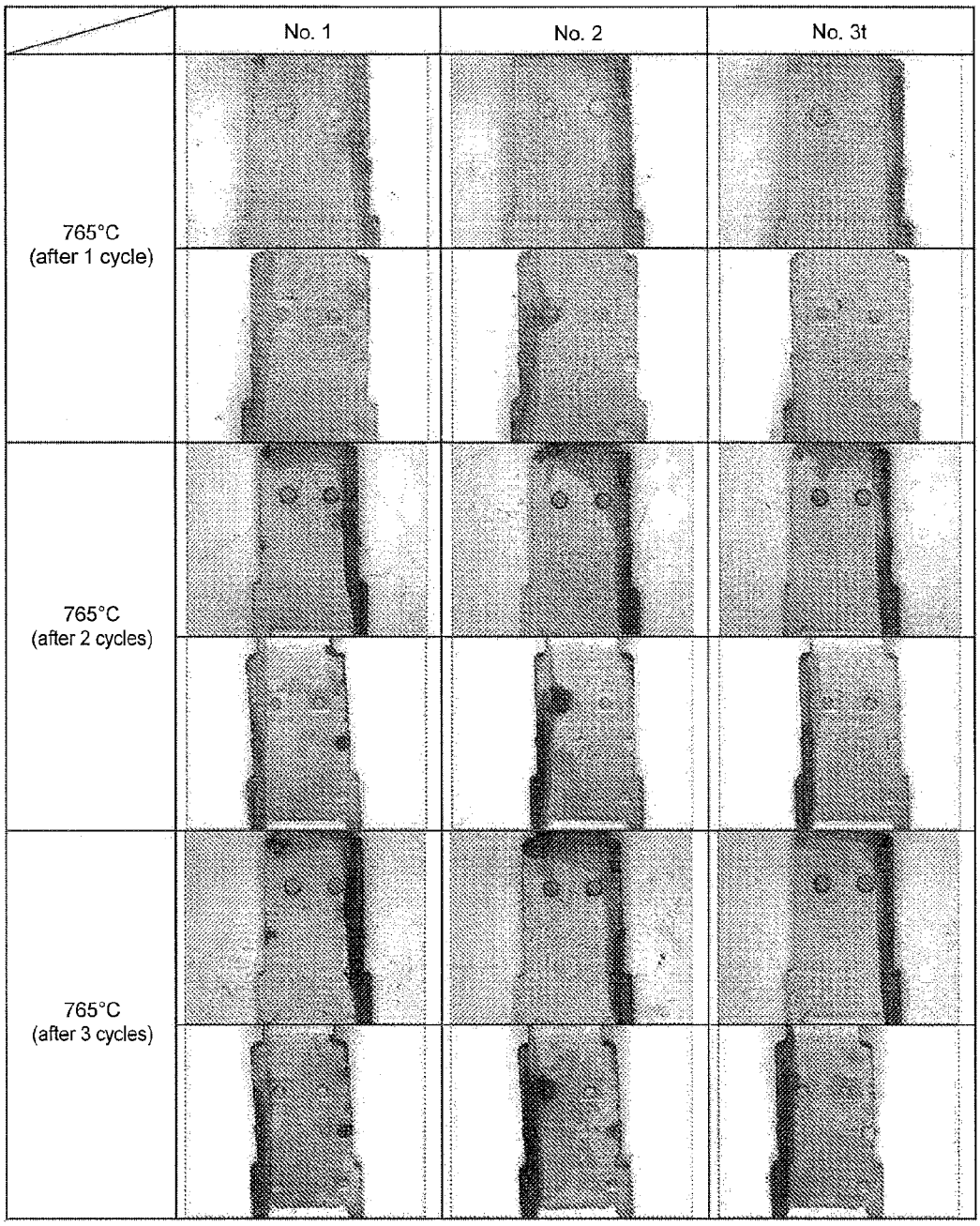
FIG. 25 is a diagram showing the test results of example 16 of the present invention.
Figure 26:
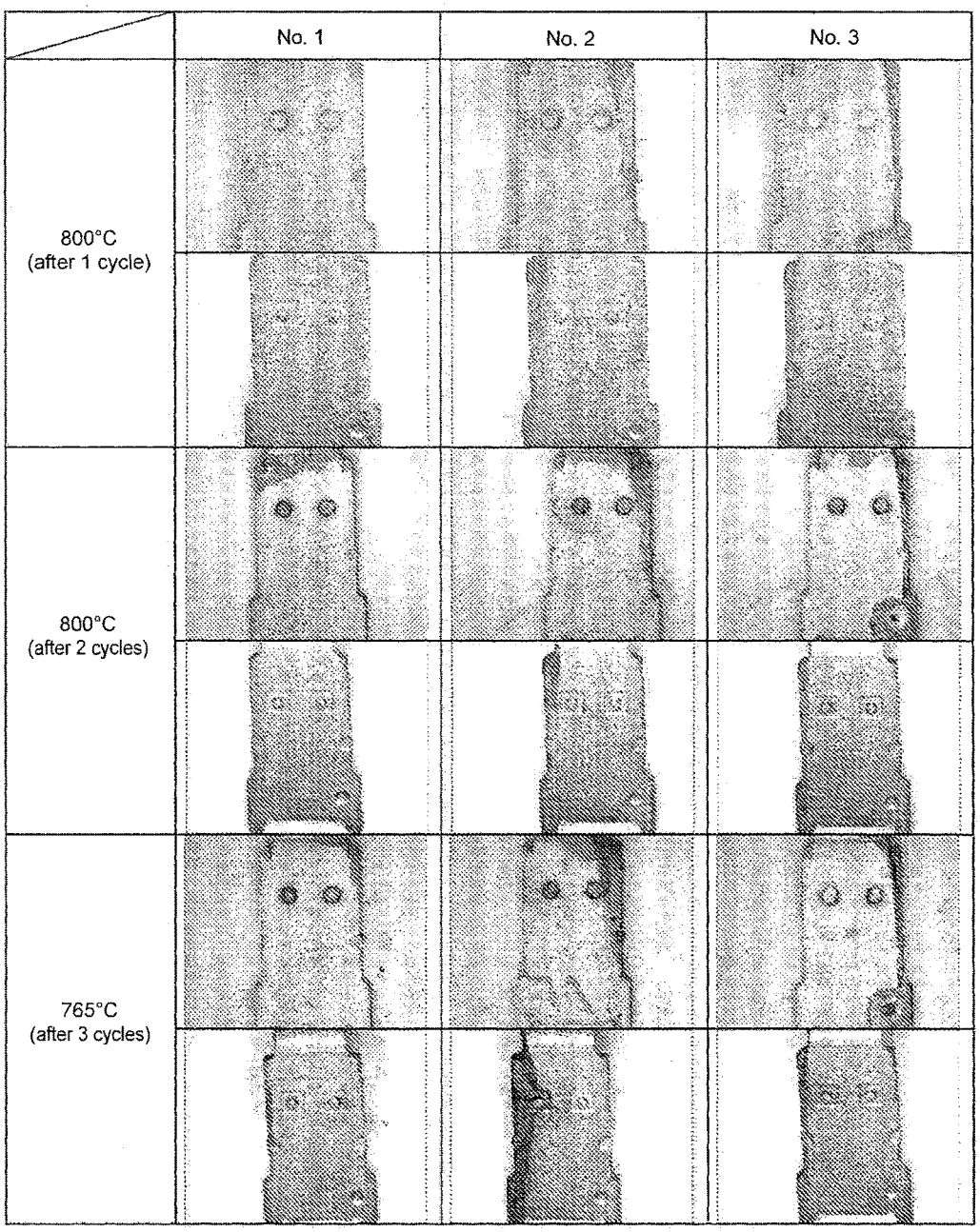
FIG. 26 is a diagram showing the test results of example 17 of the present invention.
Figure 27:
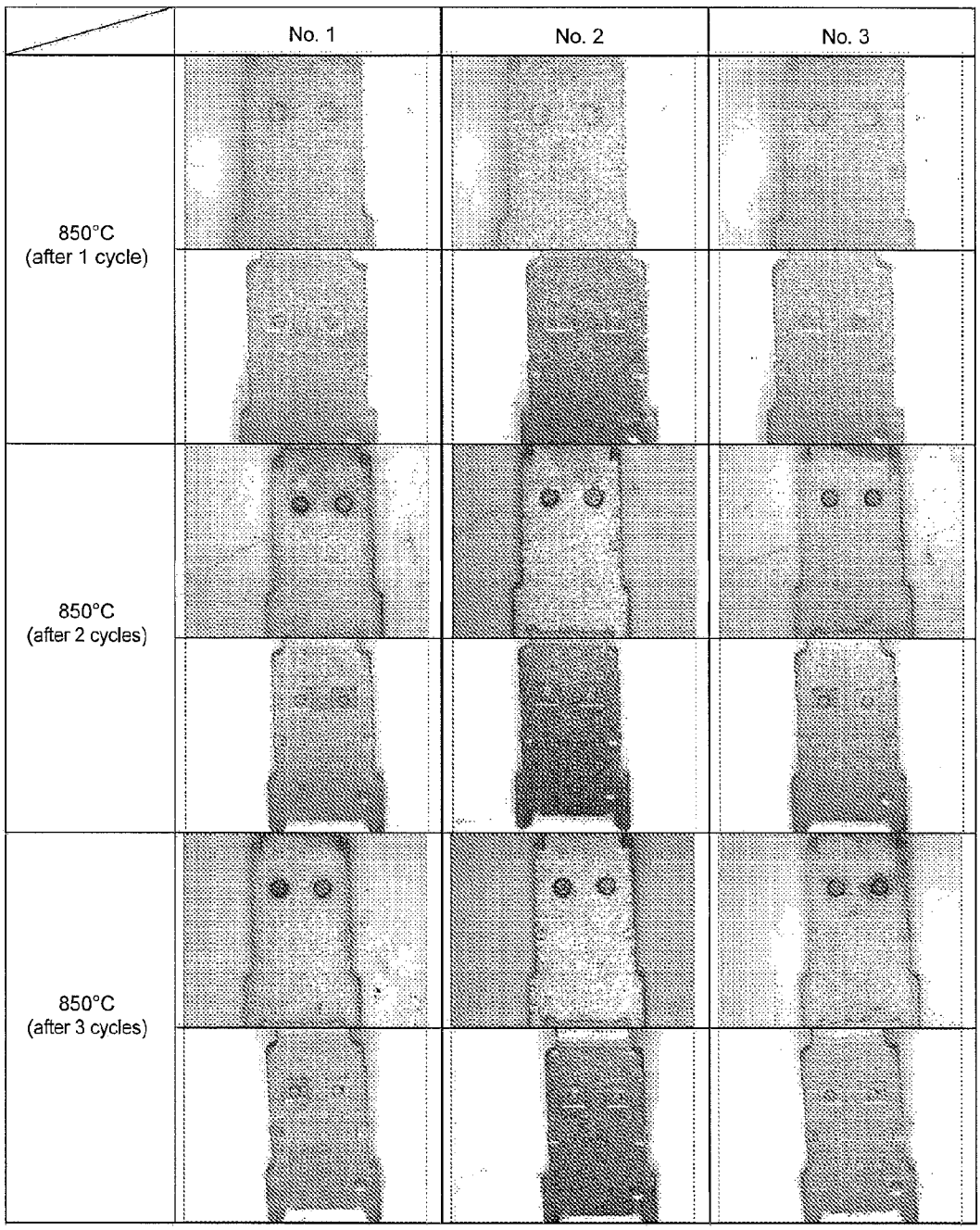
FIG. 27 is a diagram showing the test results of example 18 of the present invention.
Figure 28:
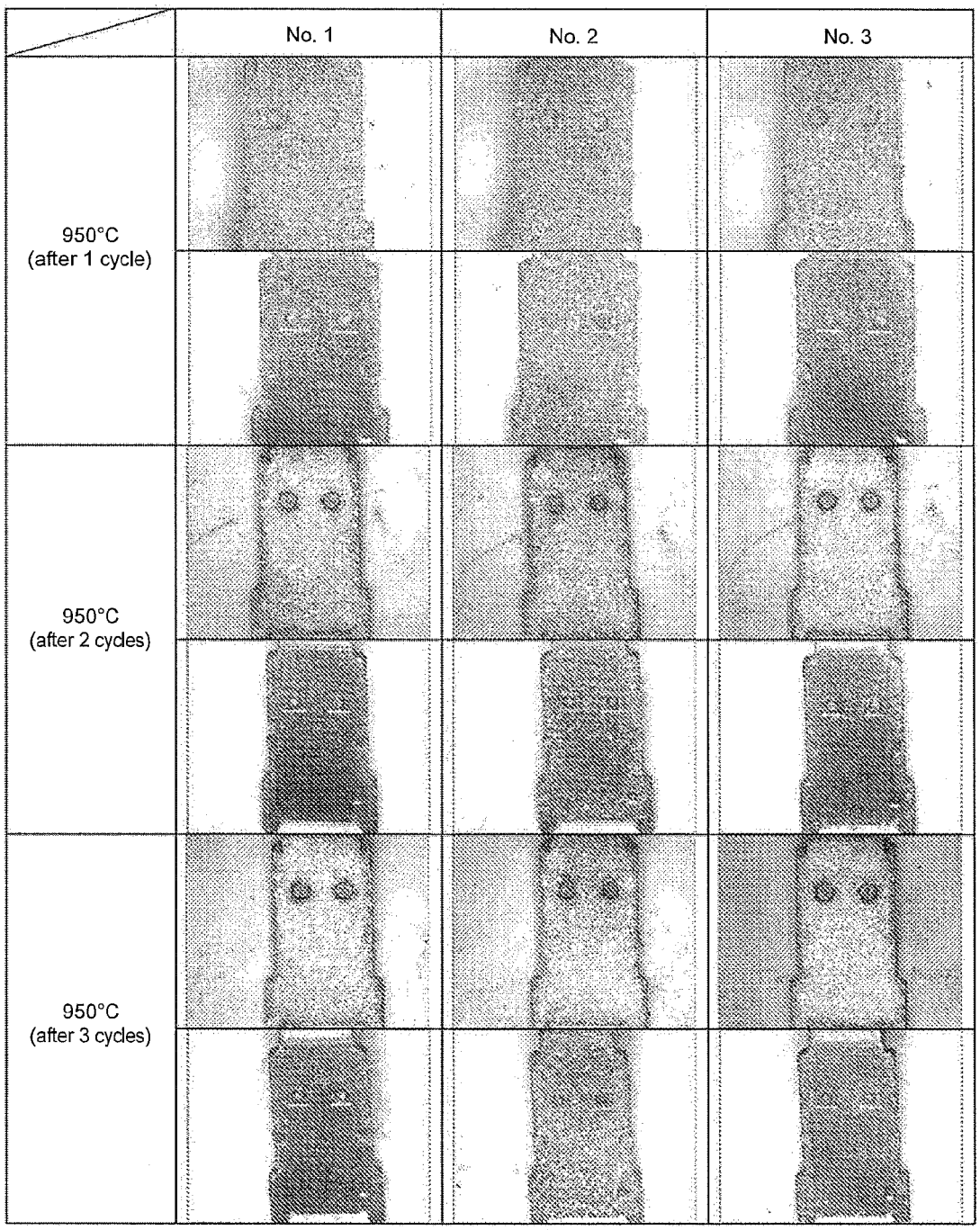
FIG. 28 is a diagram showing the test results of example 19 of the present invention.
Figure 30:
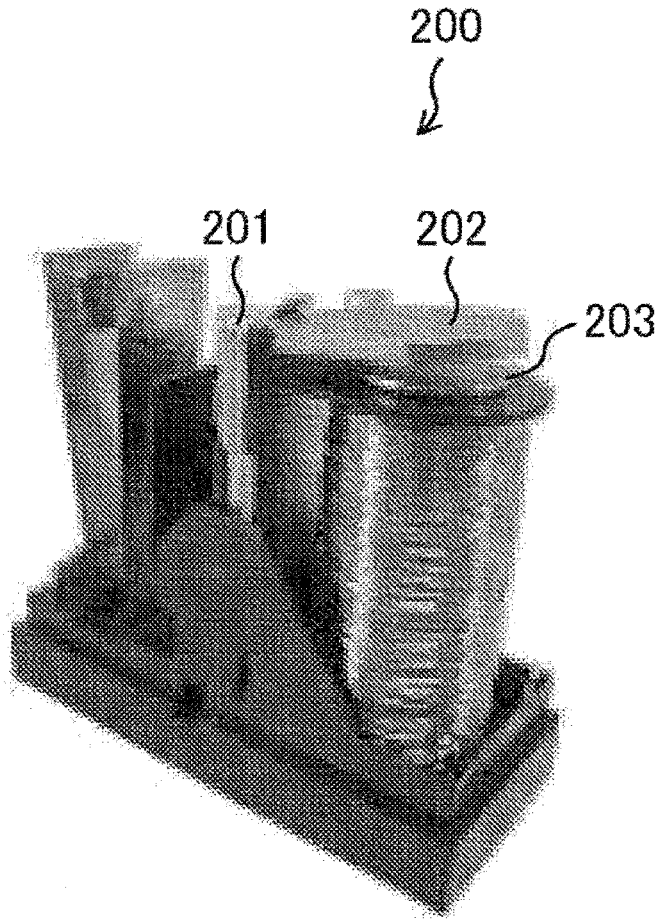
FIG. 30 is a perspective view of a relay known in the art.

FIGS. 24 to 28 shows the test results. FIGS. 24 to 28 show photographs of the yokes taken from both sides in x-direction in FIG. 5. FIG. 24 shows the results for comparative example 11. FIGS. 25 to 28 show the results for examples 16 to 19. In examples 16 to 19, the corroded areas are smaller than those in comparative example 11.

Example 20 and Comparative Example 12

For iron pieces and yokes prepared by processing SPCC, the corrosion resistance against nitric acid was examined. The iron pieces and the yokes used in example 20 were chromized using a penetrant (40 wt % of chrome powder, 59.5 wt % of alumina powder, and 0.5 wt % of ammonium chloride powder) at the treatment temperature of 860° C. for the treatment time of 9 hours. The iron pieces and the yokes used in comparative example 12 were plated with Ni. The iron piece and the yoke were mounted onto a relay, and the contact of the relay was opened and closed to generate arc heat, which then produced nitric acid gas inside the relay.

FIGS. 29A to 29D show the test results. The test pieces of example 20 have almost no patina (FIGS. 29C and 29D), whereas the test pieces in comparative example 12 (FIGS. 29A and 29B) have patina.

INDUSTRIAL APPLICABILITY

The present invention is applicable to electromagnetic relays that particularly need wear resistance, corrosion resistance, and magnetic properties.

REFERENCE SIGNS LIST

1 yoke (magnetic component)
2 iron piece (magnetic component)
3 iron core (magnetic component)
4 iron component
5 powder of at least one element selected from the group consisting of Cr, V, Ti, Al, and Si
9 contact
10 electromagnetic device
14 coil
100 electromagnetic relay

The invention claimed is:

1. An electromagnetic relay, comprising:

an electromagnetic device including a magnetic component and a coil, the magnetic component including an iron component prepared by processing an iron material; and a contact configured to be open and closed in cooperation with magnetization and demagnetization of the electromagnetic device, wherein the iron component includes an alloy layer on a surface thereof, and the alloy layer is formed by diffusion-coating of at least one element selected from the group consisting of Cr, V, and Al diffused and penetrated into the iron component, and the alloy layer has a thickness in a range of 5 to 60 μm inclusive, and wherein a total of a maximum content of the at least one element selected from the group consisting of Cr, V, and Al at a plurality of positions in the alloy layer is in a range of 29 to 50 wt % inclusive at an exterior surface of the alloy layer.

2. The electromagnetic relay according to claim 1, wherein the alloy layer is formed by diffusion-coating of the at least one element selected from the group consisting of Cr, V, and Al onto the iron component with a treatment time in a range of 5 to 15 hours inclusive at a treatment temperature in a range of 750 to 950° C. inclusive.

3. The electromagnetic relay according to claim 1, wherein the iron material has a carbon content in a range of not less than 0 wt % and less than 0.15 wt %.

4. The electromagnetic relay according to claim 1, wherein the iron component has a ferritic grain size of not more than 1 defined by JIS G0551 (2005).

* * * * *